US012677898B2

(12) United States Patent
Muskovitz

(10) Patent No.: US 12,677,898 B2
(45) Date of Patent: Jul. 14, 2026

(54) HELMET AND ADJUSTABLE CHIN STRAP ASSEMBLY AND ADJUSTABLE CHIN STRAP RETENTION SYSTEM

(71) Applicant: RESOLUTION STRATEGIC DEVELOPMENT, INC., Park City, UT (US)

(72) Inventor: David T. Muskovitz, Park City, UT (US)

(73) Assignee: RESOLUTION STRATEGIC DEVELOPMENT, INC., Park City, UT (US)

( * ) Notice: Subject to any disclaimer, the term of this patent is extended or adjusted under 35 U.S.C. 154(b) by 0 days.

(21) Appl. No.: 18/237,269

(22) Filed: Aug. 23, 2023

(65) Prior Publication Data

US 2024/0065361 A1 Feb. 29, 2024

Related U.S. Application Data

(60) Provisional application No. 63/373,435, filed on Aug. 24, 2022.

(51) Int. Cl.
*A42B 3/08* (2006.01)

(52) U.S. Cl.
CPC ..... *A42B 3/08* (2013.01)

(58) Field of Classification Search
CPC ..... A42B 3/08; A42B 3/04
See application file for complete search history.

(56) References Cited

U.S. PATENT DOCUMENTS

| | | | | |
|---|---|---|---|---|
| 3,028,602 A | | 4/1962 | Miller | |
| 3,916,446 A | * | 11/1975 | Gooding | A42B 3/08 2/421 |
| 4,890,338 A | | 1/1990 | Knabenhans | |
| 5,203,034 A | * | 4/1993 | Foehl | A42B 3/08 2/421 |

(Continued)

FOREIGN PATENT DOCUMENTS

| | | | | |
|---|---|---|---|---|
| CH | 657024 | * | 8/1986 | A42B 3/08 |
| DE | 102011012972 | * | 11/2012 | A43B 3/08 |

(Continued)

OTHER PUBLICATIONS

Machine translation DE102011012972 (Year: 2012).*

(Continued)

*Primary Examiner* — Uyen T Nguyen
(74) *Attorney, Agent, or Firm* — Workman Nydegger

(57) ABSTRACT

Disclosed are helmet and adjustable chin strap assemblies that include an adjustable chin strap retention system that solve some or all of the problems of the prior art. Specifically, disclosed are helmets and adjustable chin strap assemblies that include a helmet shell and a chin strap retention system, where the chin strap retention system includes a chin strap and an actuator that can be manipulated by the wearer using one hand to selective shorten or lengthen the chin strap in real time while the wearer is wearing the helmet and engaging in an activity. The chin strap can be configured to cleanly and simply connect to the helmet shell, with two opposing ends of the chin strap being attached to an inner component, an outer component, or between the inner and outer components of the helmet shell.

21 Claims, 22 Drawing Sheets

(56) References Cited

U.S. PATENT DOCUMENTS

| | | | | |
|---|---|---|---|---|
| 5,373,588 | A | 12/1994 | Hede et al. | |
| 5,915,538 | A | 6/1999 | Basson et al. | |
| 5,983,405 | A * | 11/1999 | Casale | A42B 3/145 2/421 |
| 6,256,798 | B1 * | 7/2001 | Egolf | A42B 3/08 2/421 |
| 6,711,751 | B1 | 3/2004 | Muskovitz | |
| 6,934,971 | B2 * | 8/2005 | Ide | A42B 3/08 2/9 |
| 8,032,993 | B2 | 10/2011 | Musal | |
| 8,438,668 | B2 | 5/2013 | Garneau et al. | |
| 9,021,616 | B2 | 5/2015 | Baty | |
| 9,622,535 | B2 | 4/2017 | Windham et al. | |
| 11,089,831 | B1 | 8/2021 | Hermansen et al. | |
| 12,317,947 | B2 | 6/2025 | Hermansen et al. | |
| 2005/0204456 | A1 | 9/2005 | Piper et al. | |
| 2010/0170068 | A1 * | 7/2010 | Musal | A42B 3/145 24/68 D |
| 2012/0167290 | A1 | 7/2012 | Kovacevich et al. | |
| 2012/0278976 | A1 * | 11/2012 | Benton | A42B 3/08 2/421 |
| 2013/0239303 | A1 * | 9/2013 | Cotterman | A42B 3/324 2/417 |
| 2013/0283507 | A1 | 10/2013 | Baty | |
| 2013/0312163 | A1 * | 11/2013 | Van Waes | A42B 3/08 2/421 |
| 2015/0033457 | A1 * | 2/2015 | Tryner | A42B 3/328 2/421 |
| 2016/0165998 | A1 | 6/2016 | Musal et al. | |
| 2016/0174648 | A1 | 6/2016 | Garneau et al. | |
| 2016/0270470 | A1 * | 9/2016 | Hickman | A42B 3/08 |
| 2018/0352909 | A1 * | 12/2018 | Fava | A42B 3/066 |
| 2019/0297985 | A1 | 10/2019 | Weber et al. | |
| 2020/0275723 | A1 | 9/2020 | Pritz et al. | |
| 2021/0153594 | A1 | 5/2021 | Rogers et al. | |
| 2021/0154560 | A1 | 5/2021 | Tryner et al. | |
| 2021/0251328 | A1 | 8/2021 | Roberts | |
| 2022/0015488 | A1 | 1/2022 | Adams et al. | |
| 2022/0175074 | A1 | 6/2022 | Rietdyk | |
| 2023/0180878 | A1 | 6/2023 | Robbins et al. | |
| 2025/0000193 | A1 | 1/2025 | Muskovitz | |
| 2025/0064164 | A1 | 2/2025 | Muskovitz | |

FOREIGN PATENT DOCUMENTS

| | | | | |
|---|---|---|---|---|
| EP | 0937416 | A2 | 8/1999 | |
| FR | 2838611 | A1 * | 10/2003 | A42B 3/08 |
| WO | 2011/051989 | A1 | 5/2011 | |

OTHER PUBLICATIONS

CH657024 (Year: 1986).*

International Search Report and Written Opinion received for PCT Patent Application No. PCT/US23/72874, mailed on Nov. 16, 2023, 14 pages.

"The Best Ballistic Helmet Chinstraps & Retention Systems", Mar. 14, 2018, 12 Pages.

International Preliminary Report on Patentability received for PCT Patent Application No. PCT/US2023/072874, mailed on Mar. 6, 2025, 9 pages.

* cited by examiner

HELMET AND ADJUSTABLE CHIN STRAP ASSEMBLY AND ADJUSTABLE CHIN STRAP RETENTION SYSTEM

CROSS-REFERENCE TO RELATED APPLICATION

This application claims the benefit of U.S. Provisional Application No. 63/373,435, filed Aug. 24, 2022, which is incorporated herein by reference in its entirety.

BACKGROUND

Technical Field

This disclosure relates generally to helmets and, more specifically, to helmets with an adjustable chin strap retention system.

Related Technology

Safety helmets are well known and may be worn when participating in a wide variety of activities. For example, helmets are typically worn for cycling, snowboarding, skiing, skateboarding, rock climbing, football, baseball, field hockey, ice hockey, horse riding, scooter riding, motorcycle riding, military action, and construction sites, just to name a few. Damage and injury can be prevented or reduced by protective headwear that prevents hard, rough, or sharp objects from coming into direct contact with a user's head. Damage and injury can also be prevented by protective headwear that absorbs and distributes the energy of an impact.

An aspect most conventional helmets share is a chin strap that connects under the wearer's chin to keep the helmet in place on the user's head during use. Ski and bike helmets typically include a chin strap that includes flexible webbing and a buckle that connects under the chin to selectively attach and release the chin strap. The webbing may connect to the helmet in multiple places and extend under the chin of the wearer during use. The length of the chin strap is typically adjustable via the buckle, which typically requires the wearer to remove the helmet to adjust the length. Adjustment to chin strips with under-the-neck buckles cannot be safely and effectively performed in real time, such as while the user is riding a bike, skiing, or engaging in sporting or other activities. Rather, such adjustments typically require the wearer to use both hands to release the buckle, adjust the strap length, and reconnect the buckle. This process may require several iterations to achieve the correct balance of comfort to the wearer and tightness for safety. Because adjusting the chin strap may be cumbersome, a wearer may decide to avoid the hassle and just "live with it", which often results in suboptimal safety and/or comfort.

The chin strap can be made of multiple pieces or parts of flexible webbing. In some helmets, a first strap is connected to the helmet behind each of the wearer's ears and a second strap is connected to the helmet in front of each of the wearer's ears. The two straps are connected together with a clasp in a Y-shaped configuration to effectively form an integrated strap. The two integrated straps may be adjustable relative to each other via the clasp to increase fit and comfort. Again, such adjustments typically require the wearer to use two hands and are performed with the helmet removed from the wearer's head.

The chin strap assists in keeping the helmet securely attached to the wearer's head. Indeed, not only do they minimize occurrences of vertical movement of the helmet being projected off of the wearer's head, but they also generally help to minimize occurrences where the helmet is pivoted off of or out of position on the front or rear portion of the wearer's head. Such off-pivoting or out-of-position alignment can expose the vulnerable part of the wearer's head to impact and injury. Thus, to ensure proper fit and safety, it is imperative for the wearer to properly adjust the tightness of the chin strap. However, for the reasons given above, a wearer may simply forgo the hassle of correctly adjusting the chin strap and instead wear the helmet with suboptimal fit, sacrificing comfort and/or safety.

Helmets undergo a series of safety tests and are required to meet certain safety standards in order to be sold on the market. Impact tests generally measure how well a helmet manages energy absorption and redistribution around the wearer's head. Roll-off tests determine how well a properly fitted helmet resists being pulled down toward or away from a wearer's face. An elongation or retention test determines how well the chin strap resists stretching or breaking when a pulling force is applied to the helmet.

While a helmet may meet certain safety standards when the chin strap is adjusted correctly, few users actually use their helmets in a correctly adjusted configuration. Moreover, adjustments are typically done when the helmet is removed from the wearer's head, requiring trial and error to make the optimal adjustments. Even after several adjustment attempts, when the buckle is connected, at least one of the straps (e.g., in front of or in back of ears) may be loose, which may allow the helmet to become dislodged in the event of a crash. Furthermore, adjustment may be so cumbersome that some wearers may be unwilling to properly tighten the chin strap because the requisite level of tightness may be uncomfortable and, much of the time, the user may not be engaging in the most dangerous part of an activity requiring a tight chin strap. Some users may wear the helmet with unevenly adjusted straps and/or which are too loose, even when they are about to engage in the most dangerous part of the activity. In some cases, wearers may release the chin strap for comfort, such as while riding a ski lift or while resting in between biking intervals. Understandably, wearers sometimes forget to buckle their chin straps, which is dangerous and could lead to the helmet falling off their head. Improper fitting of conventional straps cause a significant number of head trauma injuries, and in some cases, death. Approximately 30% of all injury-related deaths are a result of traumatic brain injuries.

Another problem is that, during use, chin straps and other webbing can become sweat-soaked and stretch or loosen. Correcting for such stretching in real time is typically not possible as the helmet usually must be removed from the wearer's head to make any fit adjustments. As such, the wearer my simply opt to have a sub-optimally fitting helmet for reasons given above, with the attendant risk and dangers of head trauma injury or even death.

In view of the foregoing, there is a long-felt but unsatisfied need for improved helmet retention systems, particularly chin strap retention systems.

SUMMARY

Disclosed are helmets and adjustable chin strap assemblies that solve some or all of the problems of the prior art. Specifically, disclosed are helmets including a helmet shell and a chin strap retention system, where the retention system includes a chin strap and actuator to adjust the length of the chin strap. The chin strap may include webbing and padding on at least a portion of the chin strap. The helmet shell may include an inner component and an outer component. The chin strap cleanly and simply connects to the shell, with two opposing ends of the chin strap being anchored, in some embodiments, to the inner and/or outer components of the shell at left and right side regions, respectively.

In some embodiments, the actuator is positioned at or near a side region of the helmet shell and operably connected with the chin strap such that actuating or otherwise manipulating the actuator can quickly and easily increase or decrease the length of the chin strap in order to selectively loosen or tighten the chin strap. In some embodiments, the actuator may releasably engage the shell to enable the chin strap to releasably engage a side region of the shell. In some embodiments, the chin strap can be a single continuous strap from a first end to an opposite second end. In some embodiments, the chin strap can be reversible such that either of the opposing ends can connect to the inner and/or outer components of the shell at either a left or right ear area of the shell.

In some embodiments, when decreasing the length of the chin strap, an extra length of chin strap can be housed in or received internally by the helmet shell. For example, the helmet shell may include a channel, groove, and/or space in or between the inner and/or outer components of the shell to receive an excess of chin strap length when shortened. In some embodiments, the inner and/or outer component of the shell may include a groove to receive the chin strap as it is being shortened and to guide the chin strap, for example, away from the wearer's head. In some embodiments, the chin strap may be received into a space between the shell and the wearer's head. In this way, the chin strap may remain entirely contained within the shell or helmet system, with no ends of the chin strap poking out or being externally accessible. In some embodiments, the extra length of the chin strap can be external to the helmet and not contained within the shell.

In some embodiments, the inner and outer components of the shell can be joined together to create a substantially uniform shell. In some embodiments, the inner and outer components of the shell are formed/manufactured together as one piece. In some embodiments, the inner and outer components of the shell are constructed from the same material. In some embodiments, the inner and outer components of the shell are two distinct, separate pieces joined together to create the shell. In some embodiments, the inner and outer components of the shell are constructed from different materials. For example, a flexible polystyrene or other polymeric inner component can be in-molded with an outer and harder shell component.

In some embodiments, a helmet and adjustable chin strap assembly comprises:

- a helmet shell configured to at least partially cover a wearer's head, wherein the helmet shell includes:
  - an outer component and an inner component;
  - a front and a back; and
  - a left side region and a right side region; and
- an adjustable chin strap retention system including:
  - a chin strap having two opposing ends, a first end configured to attach to the left side region and a second end configured to attach to the right side region; and
  - an actuator configured to attach to the left or right side region of the helmet shell and be operably connected to the first or second end of the chin strap so that actuating the actuator selectively increases or decreases a length of the chin strap relative to the left and right side regions of the helmet shell in order to selectively loosen or tighten the chin strap, respectively.

In some embodiments, the actuator may comprise a slider, detent, spring pump, ratchet system, wheel, or other means for selectively increasing or decreasing the length of the chin strap. The actuator can be releasably or non-releasably attached to a left or right side region of the helmet shell. Alternatively, the actuator can be attached to a truss of a truss pair near a side region of the helmet shell, with first and second trusses being rigidly or rotatably connected to and extending downwardly from respective left and right side regions of the helmet shell.

In some embodiments, the chin strap can include first and second Y-shaped helmet attachment structures, each configured to attach to a respective left or right side region of the helmet shell and each comprising a first strap section configured to attach to the helmet shell forward of a wearer's ear and a second strap section configured to attach to the helmet shell behind the wearer's ear. The Y-shaped helmet attachment structures may comprise fabric or molded plastic.

In some embodiments, the chin strap may comprise a single continuous strap with no buckle or other attachment feature configured to be positioned adjacent to a wearer's chin. The helmet shell may include a channel, groove, or space configured to house or receive a portion of the chin strap when shortened or lengthened by the actuator.

In some embodiments, the helmet and adjustable chin strap assembly may comprise a pinion gear connected to or that forms part of the chin strap at or near one of the two opposing ends. The pinion gear can be positioned in or adjacent to the left or right side region of the helmet shell. The actuator can be a wheel configured to engage the pinion gear such that selectively rotating the actuator in a first direction shortens the chin strap and rotating the actuator in an opposite direction lengthens the chin strap to selectively tighten or loosen the chin strap relative to the left and right side regions of the helmet shell.

In some embodiments, the helmet and adjustable chin strap assembly may include an anchor sleeve disposed in one of the left side region or the right side region and configured to receive an end of the chin strap opposite an end of the chin strap operably connected to the actuator. The helmet and adjustable chin strap assembly may further include a second anchor sleeve configured to receive the end of the chin strap operably connected to the actuator, wherein the actuator passes through the second anchor sleeve to maintain communication with chin strap.

In some embodiments, the actuator can be removably attached to the helmet shell such that removal of the actuator detaches the end of the chin strap operably connected to the actuator from the helmet shell and facilitate installation and removal of the helmet shell to and from the wearer's head. In addition or alternatively, an end of the chin strap opposite to the end attached to the actuator can be removably attached to the helmet shell such that detaching that end of the chin strap from the helmet shell facilitates installation and removal of the helmet shell to and from the wearer's head.

In some embodiments, the the actuator may include a lock configured to temporarily lock the actuator and prevent changes in the length of the chin strap while locked.

This summary is provided to introduce a selection of concepts in a simplified form that are further described below in the detailed description. This summary is not intended to identify key features or essential features of the claimed subject matter, nor is it intended to be used as an indication of the scope of the claimed subject matter.

BRIEF DESCRIPTION OF THE DRAWINGS

Various objects, features, characteristics, and advantages of the invention will become apparent and more readily appreciated from the following description of the embodiments, taken in conjunction with the accompanying drawings and the appended claims, all of which form a part of this specification. In the Drawings, like reference numerals may be utilized to designate corresponding or similar parts in the various Figures, and the various elements depicted are not necessarily drawn to scale, wherein:

DETAILED DESCRIPTION

Figure 1:
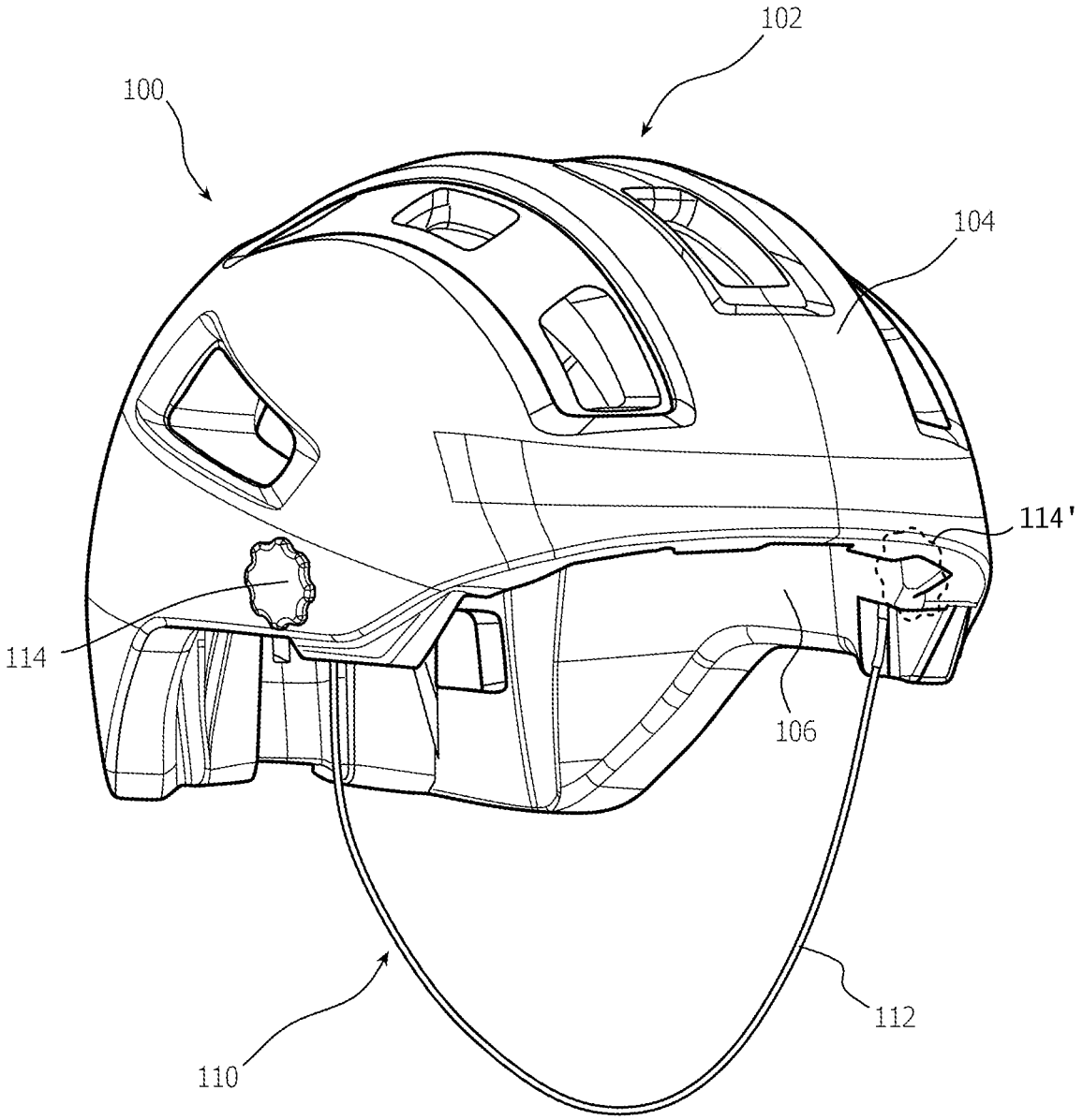
FIG. 1 schematically illustrates an embodiment of a helmet and chin strap retention system of the present disclosure.

Disclosed are helmets and adjustable chin strap assemblies that solve some or all of the problems of the prior art. Specifically, disclosed are helmets including a helmet shell and chin strap retention system, where the retention system includes a chin strap and an actuator to adjust the length of the chin strap. The chin strap cleanly and simply connects to the helmet shell, with two opposing ends of the chin strap being anchored, in some embodiments, to opposite sides of the helmet shell.

In some embodiments, the actuator is operably connected to the chin strap, such that actuating or otherwise manipulating the actuator can quickly and easily increase or decrease the length of the chin strap in real time, while the wearer is riding a bike, skiing, or engaging in other sporting events or activities, to achieve optimal comfort, tightness, and fit. In some embodiments, the actuator may releasably engage the helmet shell to enable the chin strap to releasably engage the shell to facilitate installation and removable of the helmet shell from the wearer's head. In other embodiments, an end of the chin strap opposite to the actuator may releasably engage the helmet shell. In some embodiments, the chin strap can be a single, continuous strap extending between opposing first and second ends. In some embodiments, when decreasing the length of (and, thus tightening) the chin strap, an extra length of the chin strap can be received or housed internally within the helmet shell.

In some embodiments, an inside surface of the outer component of the shell can include a groove configured to receive a portion of the chin strap as it is being shortened, and to guide the portion of the chin strap, for example, away from the user's head. In some embodiments, an outside surface of the inner component of the shell can include a groove to receive the portion of the chin strap as it is being shortened and to guide the chin strap, for example, away from the user's head. In some embodiments, the chin strap can be received into a space between the inner and outer components. In some embodiments, the chin strap can be received into a space between the shell and the user's head. In this way, the chin strap may remain entirely contained within the shell or helmet system, with no ends of the chin strap extending external to the helmet or being externally accessible. In some embodiments, the extra length of the chin strap can be external to the helmet and not contained within the shell.

In some embodiments, both ends of the chin strap may be removably or non-removably connected to the shell. In some embodiments, both ends of the chin strap can be removably or non-removably anchored between the inner and outer components of the shell. In some embodiments, both ends of the chin strap can be removably or non-removably anchored to the inner component. In some embodiments, both ends of the chin strap can be removably or non-removably anchored to the outer component of the shell. In some embodiments, the chin strap can be one continuous strap extending between left and right side regions of the helmet shell and being adjustable in length via the actuator without any portion being detached. In another embodiment, an end of the chin strap may comprise prongs, barbs, or similar mounting hardware to enable selective insertion and retention of the end of the chin strap in the helmet shell. This insertion and retention may be permanent in nature or may be reversible to allow for the quick detachment of the chin strap from the shell of the helmet.

To install or remove the helmet shell, the wearer can simply lengthen the chin strap until the helmet shell can fit over the wearer's head and chin unhindered by the chin strap. After installing the helmet with the loosened strap, the wearer can then shorten (tighten) the chin strap using the actuator to achieve a comfortable and sufficiently tight fit.

In some embodiments, the actuator may be positioned on a side region of the helmet shell. For example, the actuator may be accessed at approximately a left side region or ear area or a right side region or ear area. In some embodiments, the entirety of the actuator may be accessed at or near a left or side region or ear area of the helmet shell. In some embodiments, a portion of the actuator may be accessible at a side of the helmet and a remaining portion of the actuator may be concealed by or embedded in the helmet shell.

In some embodiments, only one end of the chin strap may be non-removably anchored to the shell. For example, the anchored end may be anchored between the inner and outer components of the shell. Alternatively, the anchored end may be anchored to one of the inner or outer components of the shell. The other end can be engageable with the shell (the inner component, the outer component, or both) and can be removed from the shell to have a free hanging chin strap end (still anchored by the other end). In some embodiments, the detachable end of the chin strap may removably attach to the shell via the actuator. In other embodiments the detachable end of the chin strap may removably engage with the shell via a buckle, snap, or other connection feature, with the non-removeable end being attached to the helmet shell via the actuator.

In some embodiments, the actuator may removably engage with the shell via a buckle, snap, or bar-type engagement. The buckle, snap, or bar-type engagement feature may be attached to the inner component, the outer component, or both, or it may be attached to a region of the chin strap at or near a left or right side region of the helmet shell. The actuator can be in communication with an end of the chin strap to selectively increase or decrease the length of the chin strap. When the actuator and free/removable end of the chin strap are disengaged from the shell, the chin strap may retain the length previously set by adjusting the actuator. Beneficially, a user may quickly detach the actuator and chin strap to remove the helmet. The user may similarly quickly attach the actuator and chin strap to the helmet without having to adjust the length or fit of the chin strap. Beneficially, this means that users will more likely retain a proper fitting helmet, reducing traumatic brain and head injuries.

Embodiments of the present disclosure provide a number of benefits, technical solutions, and advantages over prior art helmets and chin strap systems. For example, the disclosed helmet and adjustable chin strap assembly enable more accurate and easy adjustment of the chin strap and a more accurate or proper fit for the wearer. Adjustments can be made quickly and easily using one hand and without having to remove the helmet. This permits real time adjustments while engaging in an activity. Providing an accurate and proper fit beneficially leads to a decrease in both head trauma injuries and the severity of any head trauma injuries. For example, a 66% decrease of serious head injuries may be realized by a proper helmet fit.

Also beneficially, a more accurate and proper fit provides a more comfortable fit, meaning the user is more likely to wear the helmet during dangerous activities or during more dangerous parts of some activities. Further, the disclosed helmet and chin strap retention systems are applicable across a wide variety of helmet types, such as construction, bicycle, ski and snowboard helmets, and others. Still further, the disclosed retention system is contained inside and about the helmet (except for the portion that goes around the chin), beneficially providing a cleaner and more aerodynamic profile. Additionally, there are no external parts to get caught or dragged while wearing and using the helmet.

Embodiments of the present disclosure also, beneficially, simplify and streamline the chin strap retention system in comparison to the prior art. For example, embodiments of the present disclosure eliminate a buckle or actuator under the chin to secure the helmet to a user's head, which can be cumbersome and uncomfortable. The omission of the chin buckle under the chin significantly increases comfort and safety. By increasing comfort and safety by eliminating the under-chin buckle, the helmet systems facilitate a tighter and more optimally secure fit of the helmet to the wearer's head. This is because there is no buckle or actuator to cut or dig into the chin of a user, meaning they can wear the helmet with a tighter yet still comfortable fit.

Disclosed helmet systems also enable real-time adjustment of the chin strap. Specifically, a wearer of the disclosed helmet and adjustable chin strap assembly may adjust the chin strap without having to remove the helmet. With improved placement of the actuator or adjustment mechanism, a wearer of the disclosed helmet system may adjust the chin strap using one hand. Real-time adjustment and capability to adjust the chin strap with one hand means users can wear the better-fitting helmet system throughout an entire activity and through all difficulty levels of activity.

Reference will now be made to the Figures, which illustrate embodiments of helmet and adjustable chin strap assemblies that facilitate adjustment of the length and fit of the chin strap via a readily accessible actuator on a side region of the helmet that can advantageously be manipulated using one hand. It shall be understood that the Figures are illustrative only and not limiting. In addition, features shown in one Figure can be used in combination with features from one or more other Figures without limitation as long as such combination is operable and useful to achieve the purposes disclosed herein. Thus, any feature shown in one Figure can provide enabling disclosure when combined with any feature from one or more other Figures.

FIG. 1 illustrates an embodiment of a helmet and adjustable chin strap assembly 100 of the present disclosure. The helmet and adjustable chin strap assembly 100 includes a helmet shell 102 and a chin strap retention system 110, which includes a chin strap 112 and an actuator 114. The helmet shell 102 may include an outer component 104 and an inner component 106. In some embodiments, the outer component 104 can be a relatively hard, rigid layer and the inner component 106 can be a softer liner attached or joined to the outer component 104. In some embodiments, the inner component 106 may include a harness or suspension system configured to comfortably engage the wearer's head. In some embodiments, the inner component 106 may include foam, fabric, and/or padding. In some embodiments, the helmet shell 102 may further include a lining (not illustrated) that attaches and provides additional padding to the inner component 106. In some embodiments, the inner component 106 can be directly attached or bound to the outer component 104, such as by in-molding, in order for the inner and outer shell components 104, 106 to form a composite system that reinforces each other. In some embodiments, there can be a gap or space between the inner and outer components 104, 106, such as to receive a portion of the chin strap 112.

In some embodiments, both the inner and outer components 104, 106 are molded and thermoformed into a desired shape. In some embodiments, the inner and outer components 104, 106 can be in-molded together as a composite piece. In other embodiments, the inner and outer components 104, 106 can be formed separately and then joined together to create the shell 102. For example, the outer component 104 can be molded and thermoformed into a desired shape, and the inner component 106 can then be in-molded within the outer component or separately molded and then attached to the outer component 104. In some embodiments, the outer component 104 is solid and continuous (such as with a construction hard hat). In some embodiments, the outer component 104 includes vents or gaps (such as with a bicycle or ski helmet).

The chin strap retention system 110 includes a chin strap 112 and an actuator 114. As illustrated, the actuator 114 can be side-accessible and easy to reach and manipulate, thereby enabling ready adjustment of the length of the chin strap 112. The actuator 114 may be a slider, detent, spring pump, ratchet system, wheel, or other means for selectively increasing or decreasing the length of the chin strap 112. In some embodiments, both ends of the chin strap 112 can be non-removably anchored to or between the inner and outer components 104, 106 of the shell. That is, the chin strap 112 may only be adjustable in length via the actuator 114. To install or remove the helmet 100, a wearer can simply lengthen the chin strap 112 until the helmet shell 102 can fit over and around the wearer's head and chin. After initially installing the helmet shell 102 over the wearer's head, the wearer can shorten (tighten) the chin strap 112 via the actuator 114 to achieve a comfortable and properly tight fit for safety. The actuator 114 may be accessed on a side region of the helmet shell 102—either at approximately a left ear area or approximately a right ear area (as shown). In some embodiments, the left and/or right ear areas encompass a left and/or right ear perimeter of the shell 102 as well as the ear of the user. FIGS. 6A-6B and 8A-8C discussed below, illustrate placement of the actuator either over or behind the ear area.

In some embodiments, the chin strap 112 may connect to the helmet shell 102 between the inner and outer components 104, 106 of the shell. In some embodiments, the chin strap 112 can be configured to pivot about a hinge point located between the inner and outer components 104, 106 of the shell where the chin strap 112 connects. In some embodiments, the chin strap 112 may connect to the outer component 104 of the shell and be configured to pivot about a hinge point where the chin strap 112 connects to the outer component 104. For example, in some embodiments, the chin strap 112 may connect to an inner surface of the outer component 104. In some embodiments, the chin strap 112 may connect to the inner component 106 of the shell 102 and be configured to pivot about a hinge point where the chin strap 112 connects to the inner component 106. For example, the chin strap 112 may connect to an outer surface of the inner component 106.

In some embodiments, the chin strap 112 may be constructed from a cable, a strap, webbing, and/or woven materials (e.g. cotton, polyester, or a blend). The chin strap 112 may be a single, continuous strap with no buckle or actuator under the wearer's chin. In some embodiments, at least a portion of the chin strap 112 may be substantially flat, allowing for an ergonomic fit to the underside of a wearer's chin. In another embodiment, at least a portion of the chin strap 112 may be made of silicon, rubber, or plastic material. This material can allow for the chin strap 112 to maintain a more rigid shape or allow for the chin strap 112 to maintain a more secure mechanical communication with an actuator. Some materials may have anti-microbial properties, which provide the wearer the benefit of simply wiping down the chin strap 112 after use without the need to rigorously clean the chin strap 112 to avoid a stagnation of sweat or other unwanted substances.

Figure 2:
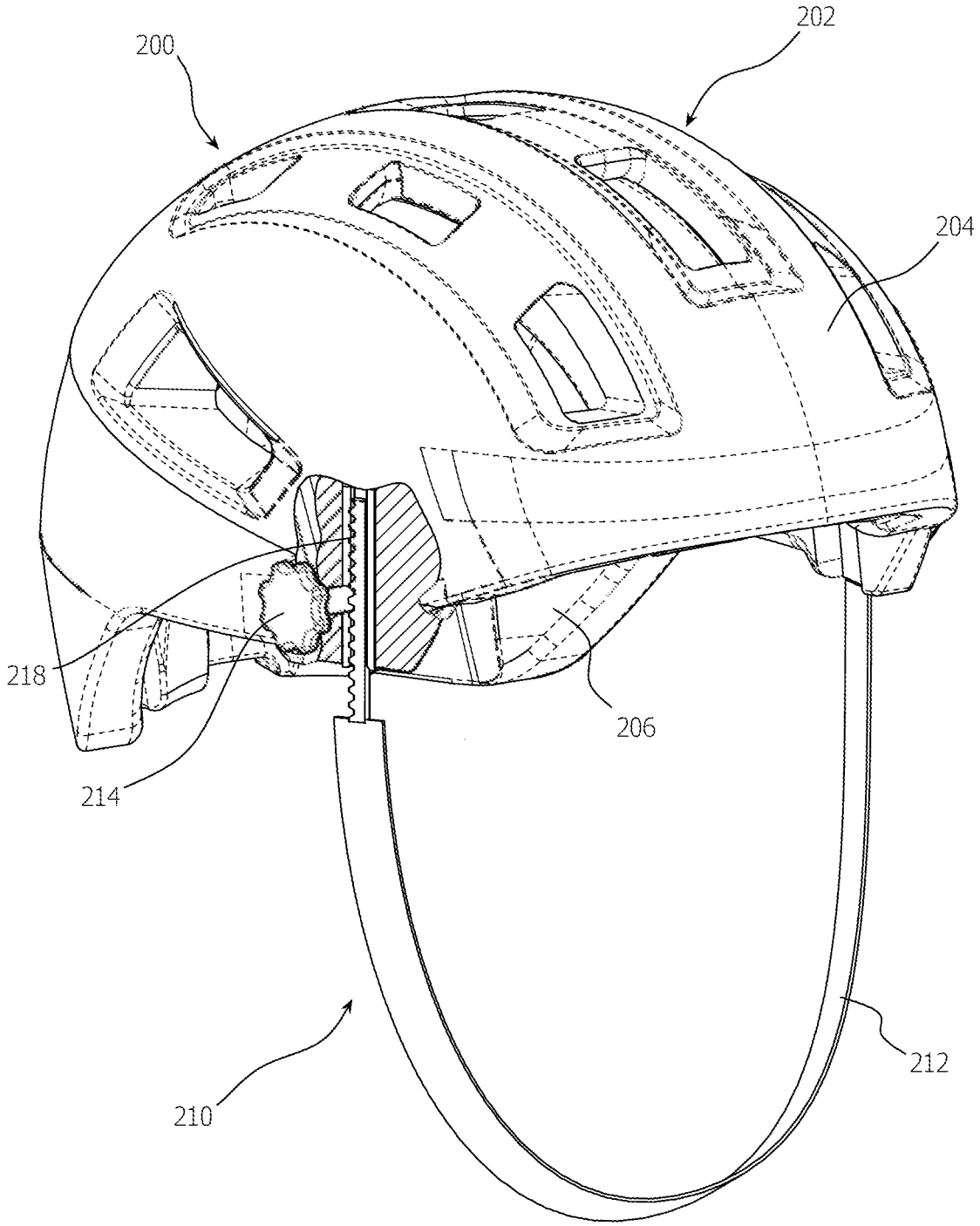
FIG. 2 schematically illustrates another embodiment of a helmet and chin strap retention system of the present disclosure.

FIG. 2 illustrates another embodiment of a helmet and adjustable chin strap assembly 200. Similar to the embodiment in FIG. 1, the helmet and adjustable chin strap assembly 200 includes a helmet shell 202 and a chin strap retention system 210, which includes a chin strap 212 and an actuator 214. A portion of the right ear area (or right side region) has been cut-away to illustrate additional components of the chin strap retention system 210. In addition to the chin strap 212 and actuator 214, the chin strap retention system 210 includes a pinion gear 218 attached at or near an end of the chin strap 212. In some embodiments, the pinion gear 218 can be positioned inside the helmet shell 202, such as between the inner and outer components 204, 206 of the shell 202. In some embodiments, the pinion gear 218 may be received by a channel or groove in the inner and/or outer components 204, 206. When the inner and outer components 204, 206 are a substantially uniform piece, the pinion gear 218 may be received by a channel in a space or gap between the inner and outer components 204, 206. In some embodiments, the pinion gear 218 can be received within either the inner or outer component 204, 206 of the shell. In alternative embodiments, the pinion gear 218 can be positioned adjacent to the helmet shell 202.

As further illustrated, the actuator 214 is configured to engage the pinion gear 218, which forms part of or is connected to the chin strap 212. In some embodiments, the pinion gear 218 can be an extension of the chin strap 212, in which an end portion of the chin strap 212 forms the pinion gear 218. In some embodiments, the pinion gear 218 can be a separate piece attached or connected to a terminal end of the chin strap 212. Actuating or otherwise manipulating the actuator 214 engages the pinion gear 218 to selectively increase or decrease the length of the chin strap 212 in order to selectively loosen or tighten the chin strap 212 relative to the left and right side regions of the helmet shell 302.

Figure 3A:
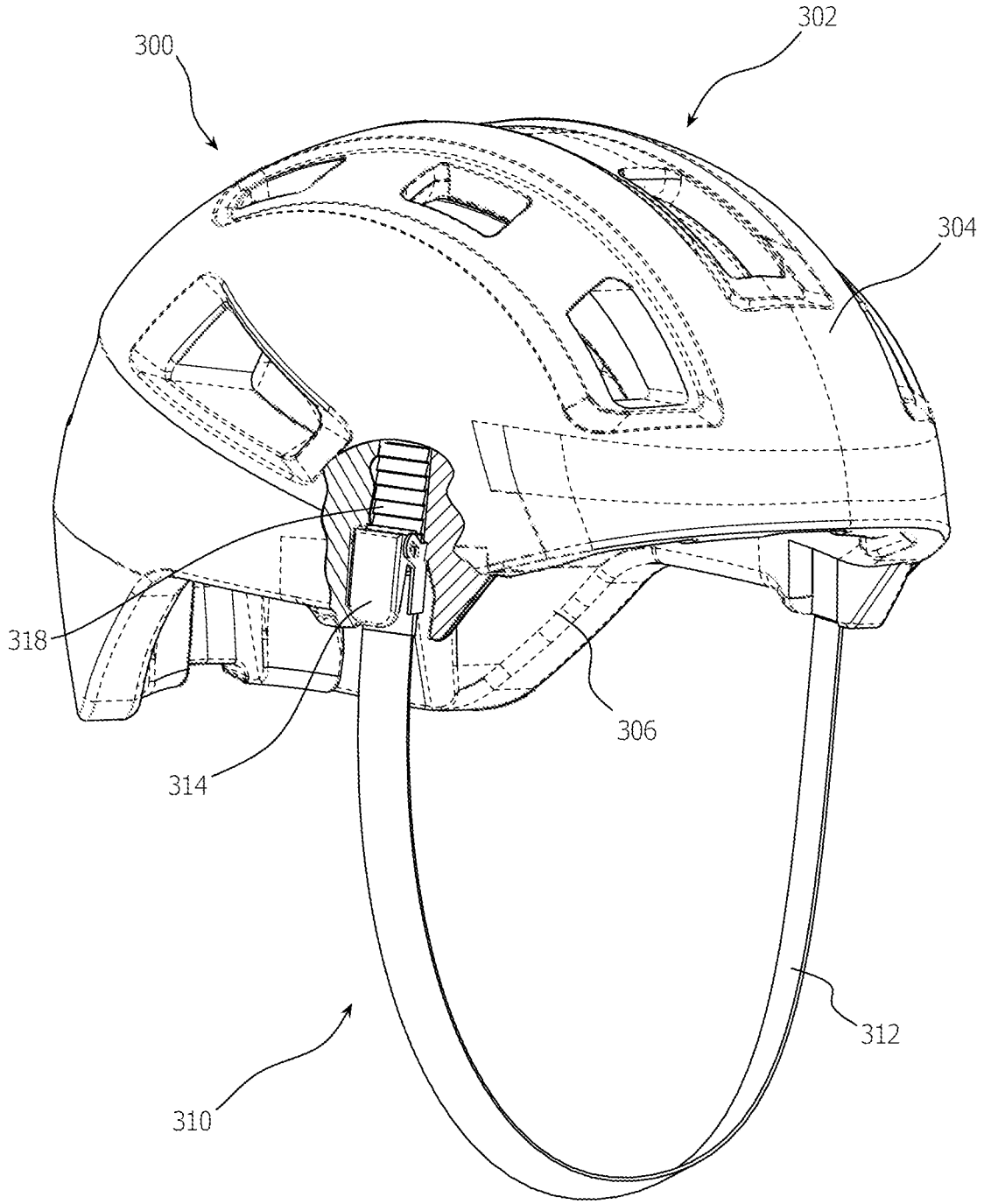
FIGS. 3A-3B schematically illustrate other embodiments of a helmet and chin strap retention system of the present disclosure.
Figure 3B:
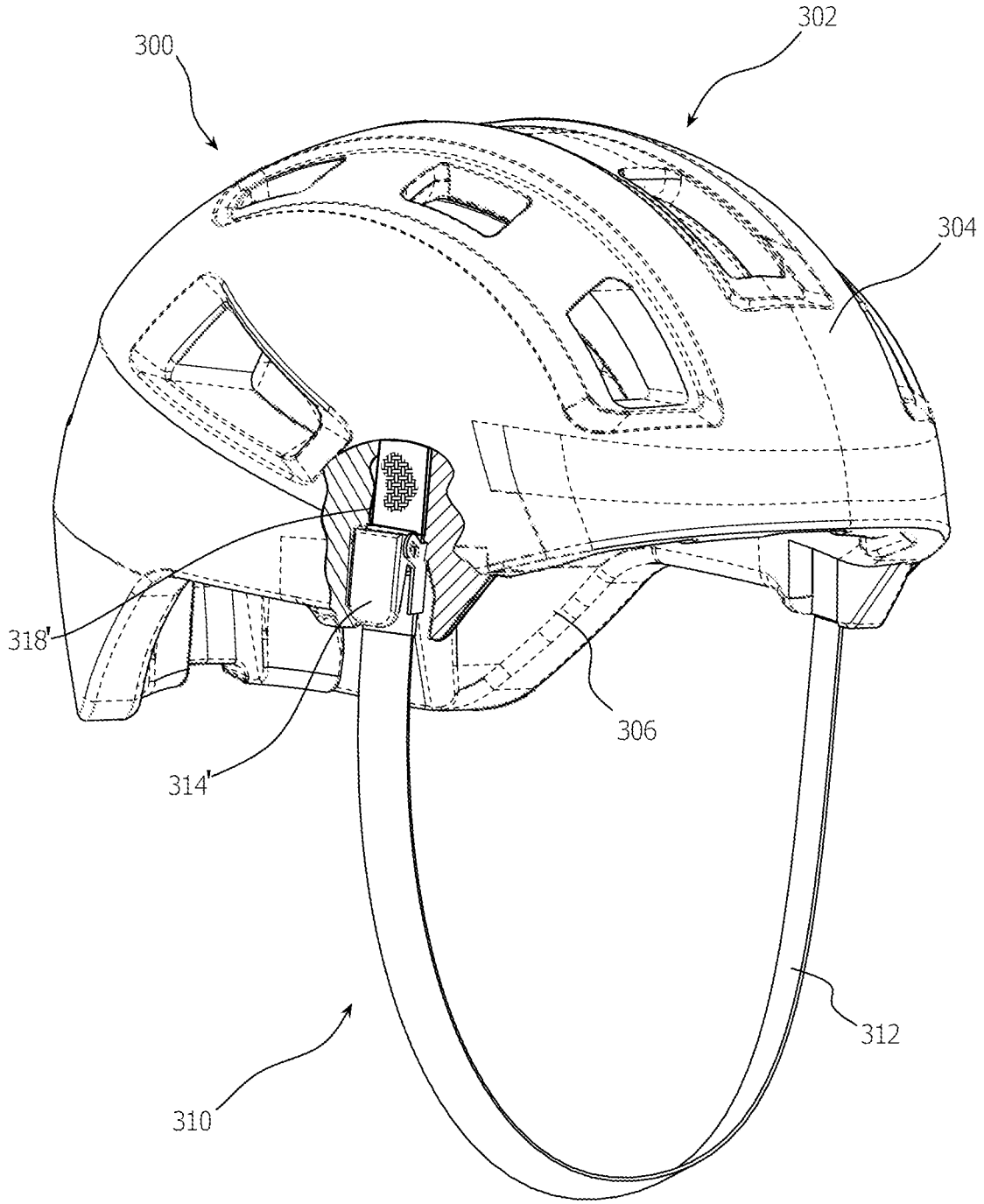

FIGS. 3A and 3B illustrate another embodiment of a helmet and adjustable chin strap assembly 300 of the present disclosure. Similar to the embodiment in FIGS. 1 and 2, the helmet and adjustable chin strap assembly 300 includes a helmet shell 302 and a chin strap retention system 310, which includes a chin strap 312 and an actuator 314. A portion of the right ear area has been cut-away to illustrate additional components of the chin strap retention system 310. In addition to the chin strap 312 and actuator 314, 314', the chin strap retention system 310 includes teeth or ridges 318 (FIG. 3A) or fabric 318' (FIG. 3B). As illustrated in FIG. 3A, the actuator 314 can be a buckle that can be selectively opened or closed to engage one or more of the teeth or ridges 318 to lock the chin strap 312 at a selected length. As alternatively illustrated in FIG. 3B, the actuator 314' can be a buckle that can be selectively opened or closed to engage a selected region of the fabric 318' to lock the chin strap 312 at a selected length.

In some embodiments, the teeth or ridges 318 or fabric 318' can be receivable between the inner and outer components 304, 306 of the shell 302. In some embodiments, the teeth or ridges 318 or fabric 318' can be positioned adjacent to the helmet shell 302. In some embodiments, the teeth or ridges 318 or fabric 318' can be received within either the inner or outer components 304, 306 of the helmet shell 302.

As illustrated, the buckle 314 may engage the teeth or ridges 318 or fabric 318', which are connected to, or form an extension of, the chin strap 312. In some embodiments, the teeth or ridges 318 or fabric 318' can be an extension of an end portion of the chin strap 312. In some embodiments, the teeth or ridges 318 or fabric 318' can be a separate piece attached or connected to a terminal end of the chin strap 312. The buckle 314, 314' can be selectively opened or closed to release from or engage with teeth or ridges 318 or fabric 318' to adjust the length of the chin strap 312 and lock it at a selected length and tightness.

Figure 4:
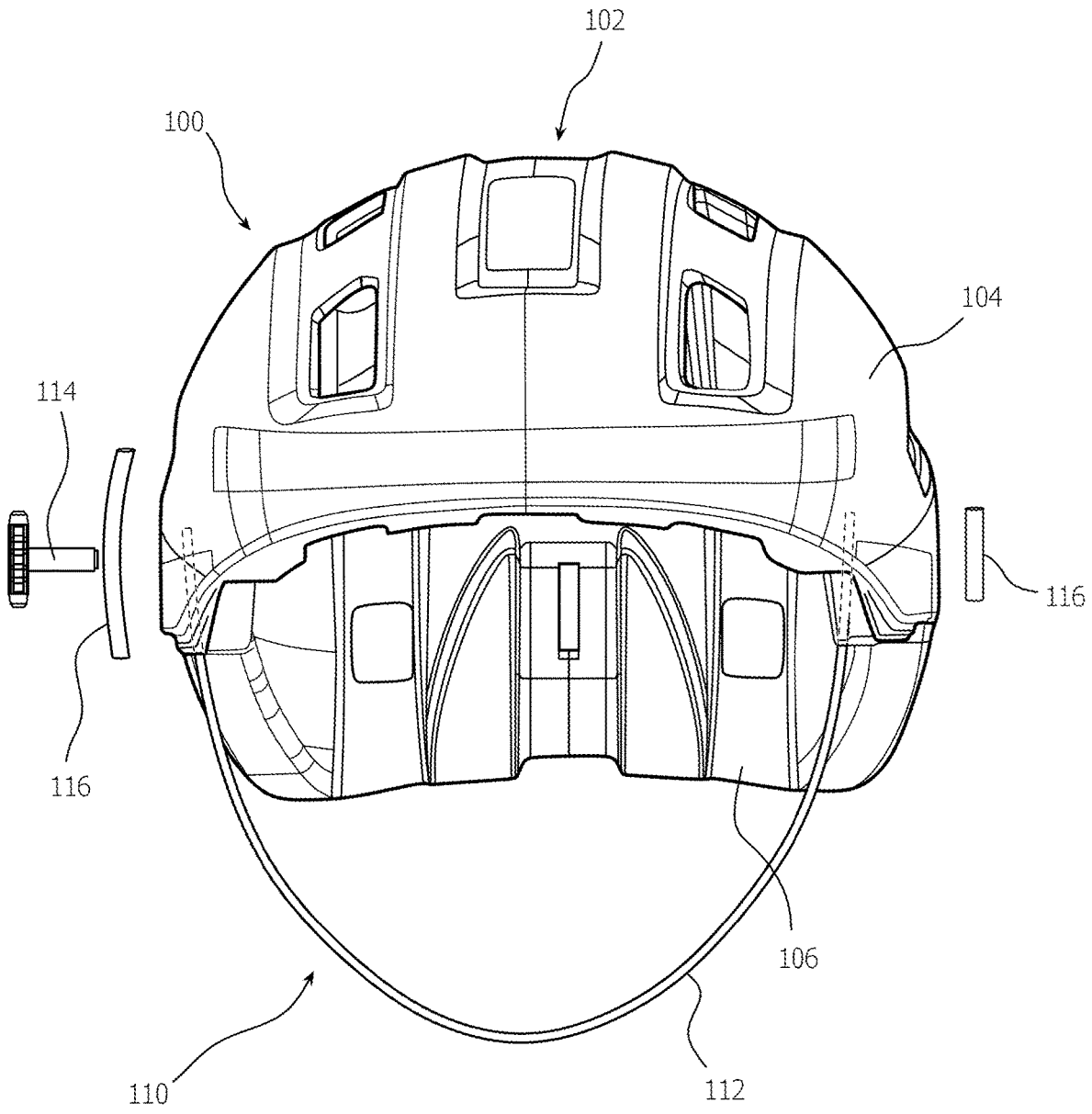
FIG. 4 schematically illustrates an exploded view of the helmet and chin strap retention system of FIG. 1.

FIG. 4 is an exploded view of the helmet and adjustable chin strap assembly 100 of FIG. 1. The helmet and adjustable chin strap assembly 100 includes a helmet shell 102 and a chin strap retention system 110, which includes a chin strap 112 and an actuator 114. The helmet shell 102 includes inner and outer components 104, 106. As illustrated, the actuator 114 is side-accessible, easy to reach and turn, enabling easy adjustment by the wearer to loosen or tighten the chin strap 112 in real time. A user can easily access and manipulate the actuator 114 without having to remove the helmet and without having to turn or contort their body to do so while engaging in activities.

The chin strap retention system 110 may include at least one anchor sleeve 116. The chin strap retention system 110 illustrated in FIG. 4 includes two anchor sleeves 116. The anchor sleeves 116 are configured to receive the opposing ends of the chin strap 112 at the left ear area, the right ear area, or both. The anchor sleeves 116 are configured to provide a space or channel for the opposing ends of the chin strap 112 of the retention system 110 to be hidden and slide within an interior of the helmet shell 102. The anchor sleeves 116 can be configured to anchor the opposing ends of the chin strap 112 to the helmet shell 102. For example, the anchor sleeves 116 may be simple slots or channels that engage the opposing ends of the chin strap 112. The slots or channels may be integral to the inner and/or outer component 104, 106. The anchor sleeves 116 may be one-way push-to-connect type sleeves, where an end of the chin strap 112 is inserted into the anchor sleeve 116, engaged with the anchor sleeve 116, and cannot be pulled out of the anchor sleeve. The anchor sleeves 116 may be a detent-type slot, where a pin on one end of the chin strap 112 engages with a hole in the anchor sleeve 116. To remove the end of the chin strap 112, the user would simply push the pin through the hole and pull on the chin strap 112 to remove the end of the chin strap 112. In some embodiments, the anchor sleeves 116 may be simple channels defined by the inner and outer components 104, 106 of the helmet shell 102 rather than being additional and/or discrete pieces.

The anchor sleeves 116 can be configured to enable the actuator 114 to remain in communication with the chin strap 112 at either the left or right ear area. The anchor sleeves 116 may be in-molded to the shell 102 of the helmet 100 or may be removable, separate pieces. In some embodiments, the anchor sleeves 116 may be formed of a hard and rigid material, such as plastic or metal, to prevent the deformation of the anchor sleeve during use. Additionally, and/or alternatively, the anchor sleeves 116 may be slots, channels, or grooves defined by either the inner or outer components 104, 106, or both. Beneficially, incorporating the anchor sleeves 116 into the shell 102 of the helmet 100, or into either the inner or outer components 104, 106 of the shell, effectively hides them from view and simplifies the overall look of the helmet 100. Further, positioning the anchor sleeves 116 (or the defined grooves) into the shell 102 of the helmet 100 leaves the inner surface of the helmet 100 clean and smooth, adding to the comfort level of the helmet 100.

The chin strap 112 can be continuous and substantially U-shaped. As illustrated, the chin strap 112 has a consistent outer diameter, though the chin strap 112 may have a varying outer diameter. For example, the chin strap 112 may narrow near a middle portion of the chin strap 112 to increase a comfort level for the user of the helmet 100. Similarly, narrowing the chin strap 112 near the middle portion may enable padding to be attached to the middle portion of the chin strap 112 to increase a comfort level for the user of the helmet 100. In some embodiments, the chin strap 112 may be constructed from or include webbing and/or another woven material. The chin strap 112 may also allow for padding to be selectively added or remove on at least a portion of its length.

In some embodiments, the chin strap 112 may be configured to pivot at an anchor or hinge point where the chin strap 112 connects to or is anchored to the helmet shell 102. For example, the anchor sleeves 116 may be configured to pivot where they are positioned (e.g., between the inner and outer components 104, 106 of the helmet shell 102). In some embodiments, the anchor sleeves 116 may be configured to allow the chin strap 112 to pivot relative to the helmet shell 102.

Figure 5:
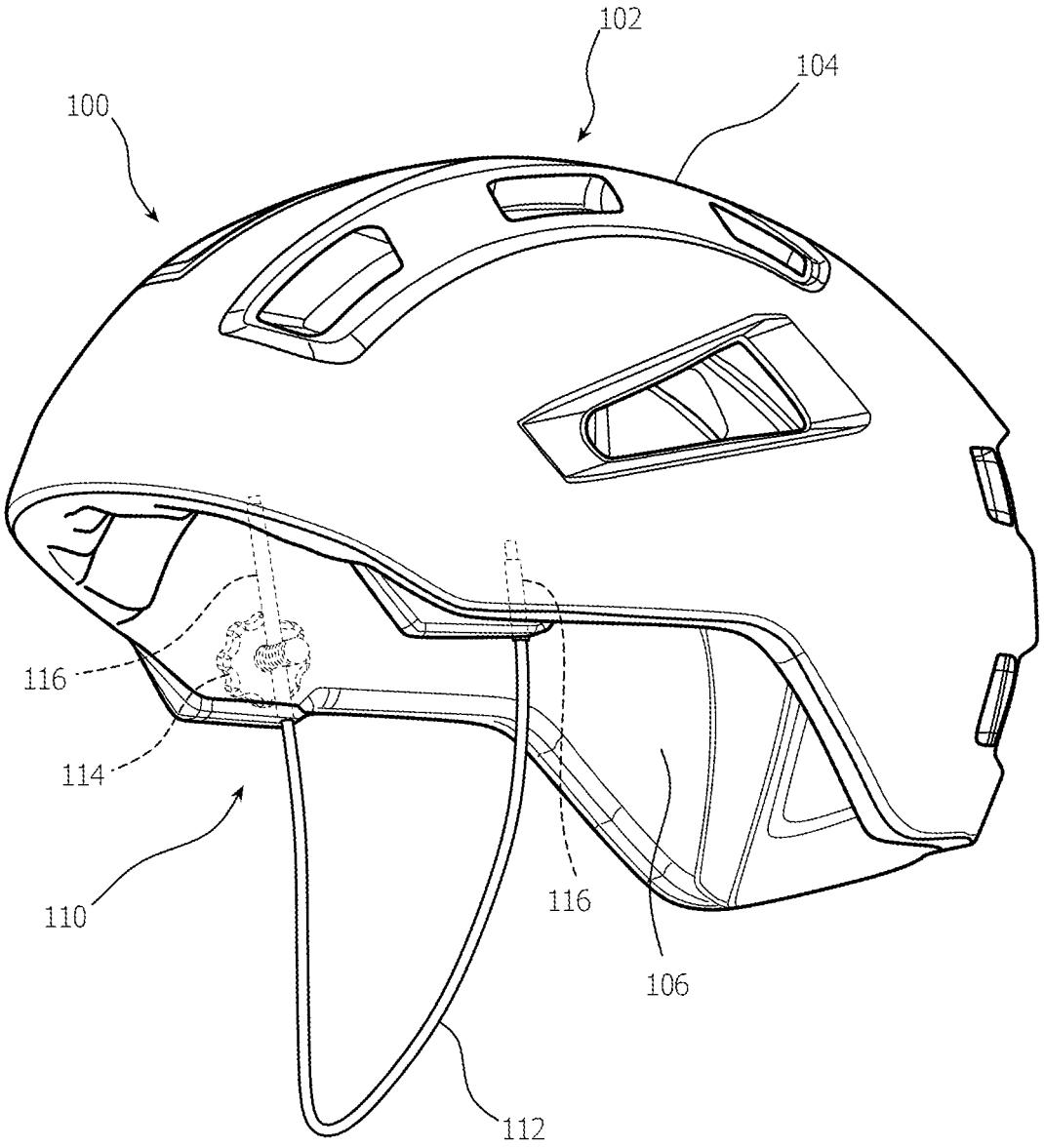
FIG. 5 is a partially transparent view of the helmet and chin strap retention system of FIG. 1.

FIG. 5 illustrates a partially transparent view of the helmet and adjustable chin strap assembly 100 of FIG. 1. As illustrated, the anchor sleeves 116 are in-molded inside both the right and left ear areas of the shell 102. The anchor sleeves 116 may be in-molded between the inner and outer components 104, 106 of the shell 102. In some embodiments, the anchor sleeves 116 may be formed only in the inner component 106 or only in the outer component 104. In some embodiments, the anchor sleeves 116 can be channels (rather than additional discrete pieces) defined by the inner and outer components 104, 106, such that the channels are configured to receive the opposing ends of the chin strap 112. The chin strap 112 may engage with the anchor sleeves 116 at the left and/or right ear areas.

As illustrated, the actuator 114 can be a wheel that is in communication with and operably connected to the chin strap 112. Rotating the wheel one direction or the other can selectively increase or decrease the length of the chin strap 112, enabling a wearer to fit the helmet 100 over and around his or her head and selectively loosen or tighten the chin strap 112 to achieve a proper, comfortable, and safe fit. Further adjustments can be made by the wearer in real time to loosen or tighten the chin strap as circumstances may permit or dictate. In some embodiments, the actuator 114 can extend through the anchor sleeve 116 or channel to be in communication with the chin strap 112. In some embodiments, the actuator 114 can be in communication with the chin strap 112 and located at an area just below the anchor sleeve 116.

Figure 6A:
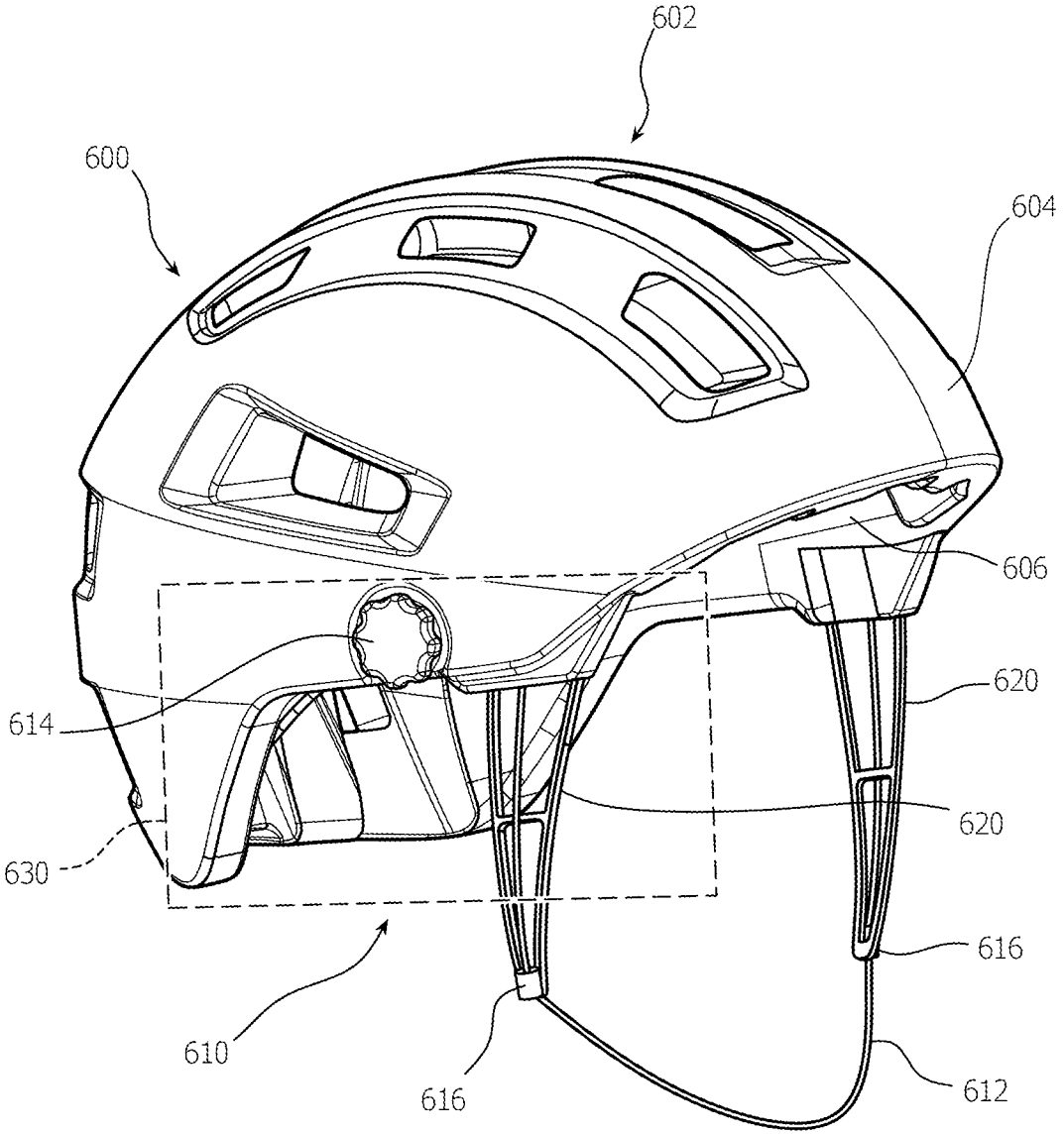
FIGS. 6A-6B schematically illustrate other embodiments of a helmet and chin strap retention system including a truss pair.
Figure 6B:
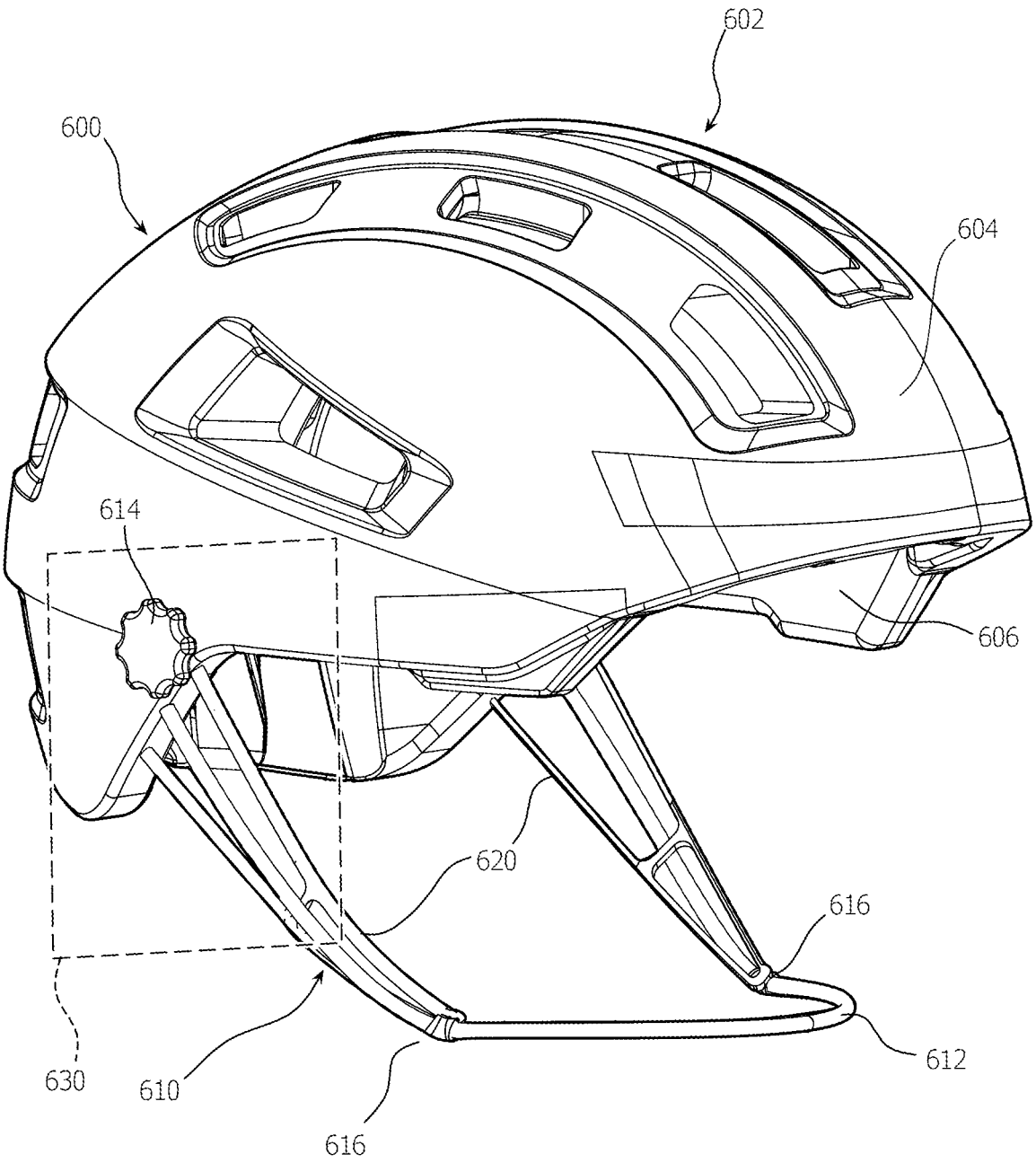
Figure 7:
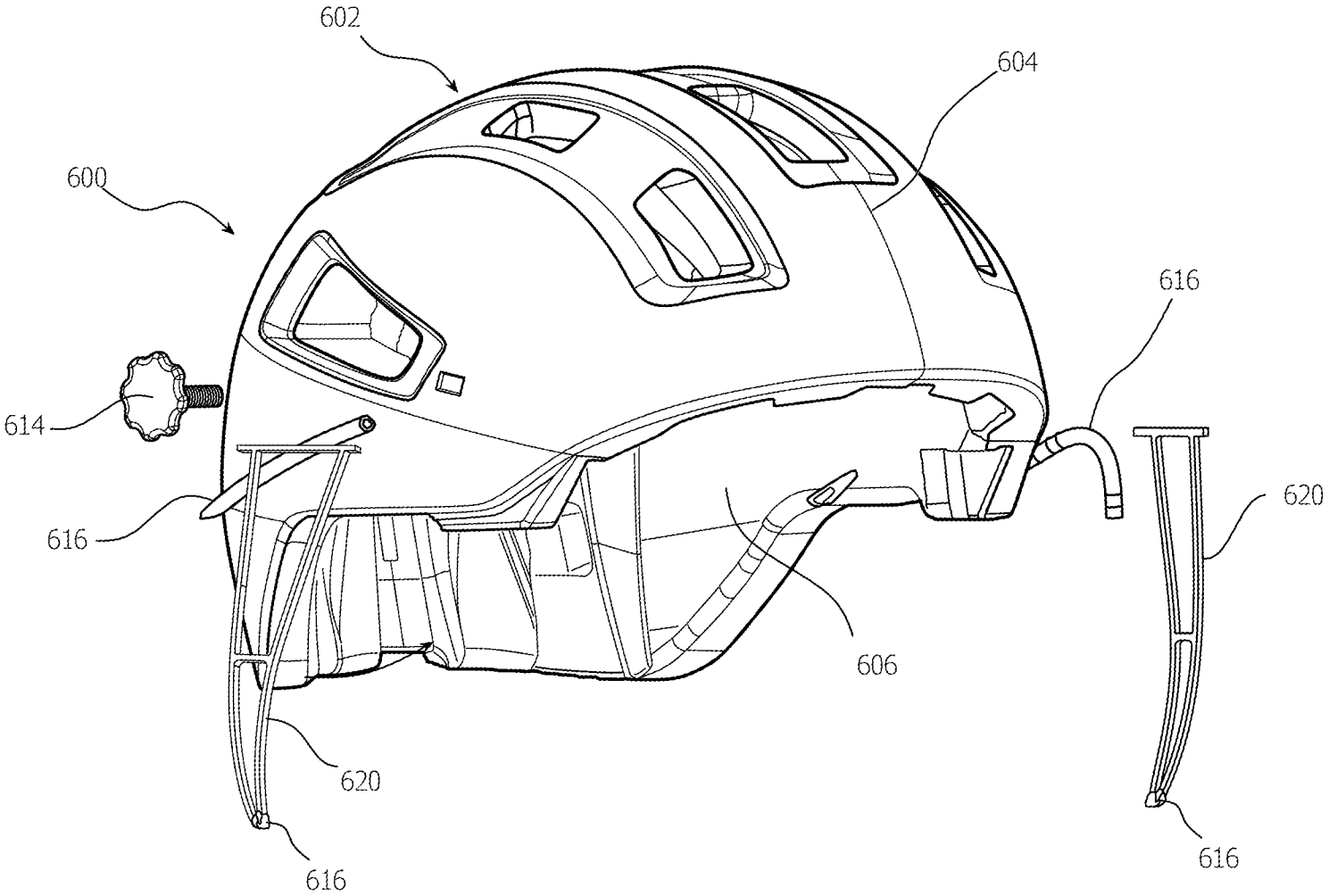
FIG. 7 is an exploded view of the helmet and chin strap retention system of FIG. 6.

FIGS. 6A-6B and 7 illustrate another embodiment of a helmet and adjustable chin strap assembly 600, which includes a truss pair 620 and an outline of the area approximately encompassed by the left and/or right ear areas 630. FIG. 7 is an exploded view of the helmet and adjustable chin strap assembly 600 and truss pair 620 shown in FIGS. 6A-6B. FIG. 6A shows the truss pair 620 attached and/or anchored to the helmet shell 602 at an upper portion of the left and right ear areas 630, respectively. FIG. 6B illustrates the truss pair 620 attached and/or anchored to the shell 602 at lower side portions of the left and right ear areas 630, respectively.

As illustrated, the helmet and adjustable chin strap assembly 600 includes a helmet shell 602 (with inner and outer components 604, 606) and a chin strap retention system 610, including a truss pair 620. The truss pair 620 may extend downward and away from the helmet shell 602 at the left and right ear areas 630. The left and right ear areas 630 may encompass left and right ear perimeter of the helmet shell 602, respectively, as well as at least a portion of the truss pair 620. The space the truss pair 620 resides in is delineated by the dotted box in FIGS. 6A and 6B. In some embodiments, the left and right ear areas 630 encompass substantially all of the truss pair 620. The truss pair 620 may be made of the same material as the shell 602 or may be made from a more flexible material. In some embodiments, the truss pair 620 may be in-molded to the left and right ear areas 630, between the inner and outer surfaces 604, 606 of the shell. In some embodiments, the truss pair 620 may be attached to the left and/or right ear areas 630 after the shell has been constructed. In some embodiments, the truss pair 620 may be pivotably attached to the helmet shell 602.

The truss pair 620 may include an anchor fitting 616 configured to receive a portion of the chin strap 612. The anchor fitting 616 may be similar to or substantially the same as anchor sleeves 116 (see FIGS. 4-5). The chin strap 612 may be inserted through the anchor fitting 616 and truss pair 620 and into the shell 602. In some embodiments, the anchor fitting 616 of each truss of the truss pair 620 may retain the chin strap 612 in place and prevent it from rotating and/or sliding around during use of the helmet 600. In some embodiments, the anchor fitting 616 of each truss of the truss pair 620 may provide a hinge point about which the chin strap 612 may pivot or rotate. In some embodiments, the anchor fitting 616 can be slidable along the chin strap 612 to aid in adjusting a comfort and fit of the helmet 600. In some embodiments, the opposing ends of the chin strap 612 may engage with additional anchor sleeves (not shown) positioned between the inner and outer components 604, 606 of the shell 602. As illustrated in FIG. 4, one or both of the additional anchor sleeves may have a curvature, following the curvature of the shell. In another embodiment, the chin strap 612 may be retained by the truss pair 620 by means of loops or clips along the length of each truss. The chin strap 612 would then be selectively fed through the loops or engaged by the clips by the user allowing for easy replacement of the chin strap 612.

Though not illustrated, in some embodiments, the actuator 614 may be attached to a portion of the truss pair 620 at or near a left or right side portion rather than to the helmet shell 602 itself. In this configuration, the actuator 614 would still be in communication with the chin strap 612 at or near a left or right side portion of the helmet shell 602 and enable the wearer to easily increase and/or decrease the length of the chin strap 612 in real time.

The truss pair 620 beneficially provides support for the chin strap 612, increasing the safety of the helmet 600 and comfort for the user. Beneficially, the truss pair 620 may obviate the need for rear straps or webbing behind the ear, which are typically used in conventional helmets. In some embodiments, the chin strap retention system 610 may further include a lock. The lock may be engaged to lock the actuator 614 to prevent a change in the length of the chin strap 612. Such lock may beneficially maintain the predetermined length of the chin strap 612 during high intensity activities, such as alpine skiing/snowboarding or rock climbing.

Figure 8A:
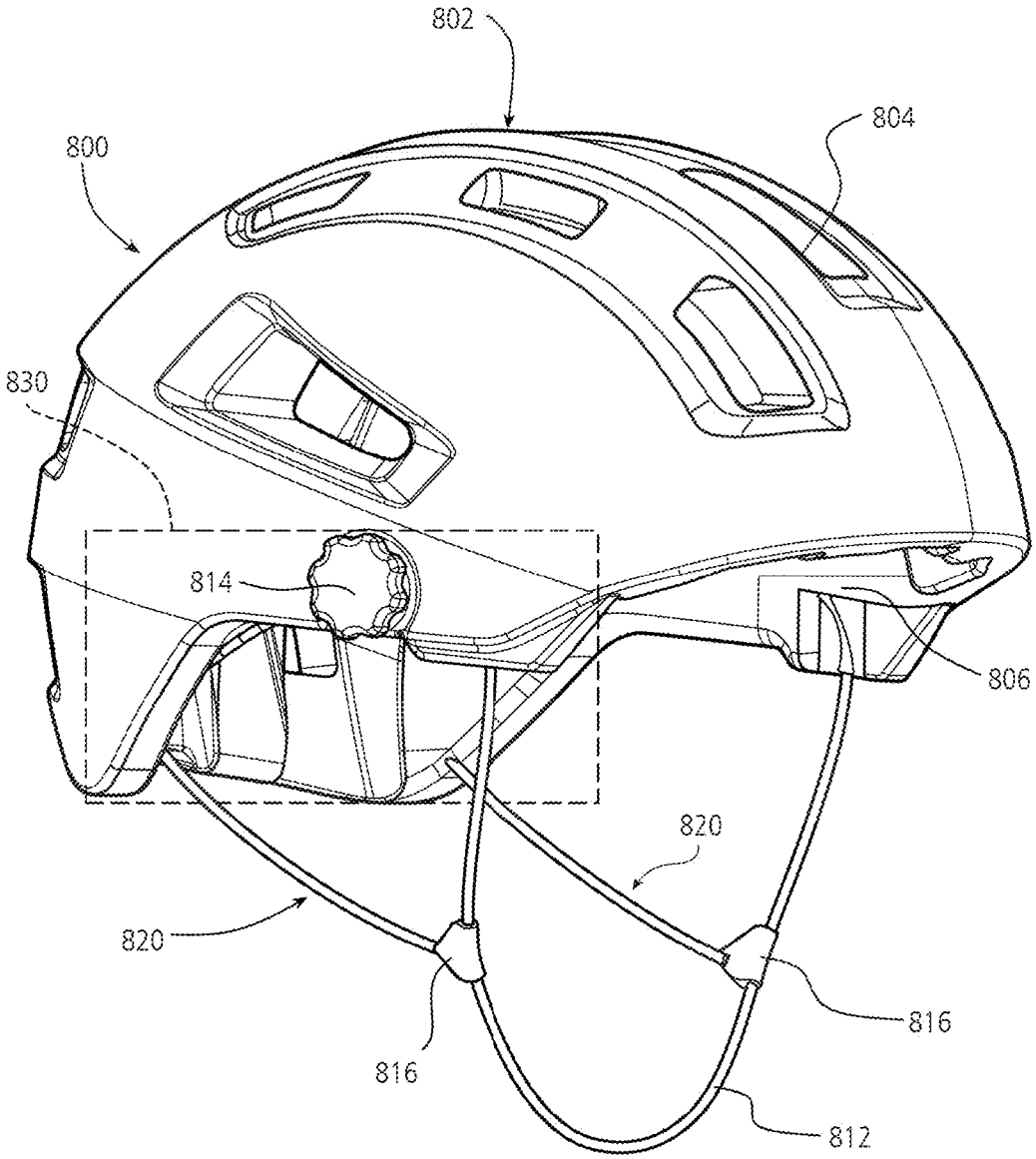
FIGS. 8A-8C schematically illustrate other embodiments of a helmet and chin strap retention system including Y-shaped helmet attachment structures, each including a rear tether or leash and a forward tether or leash.
Figure 8B:
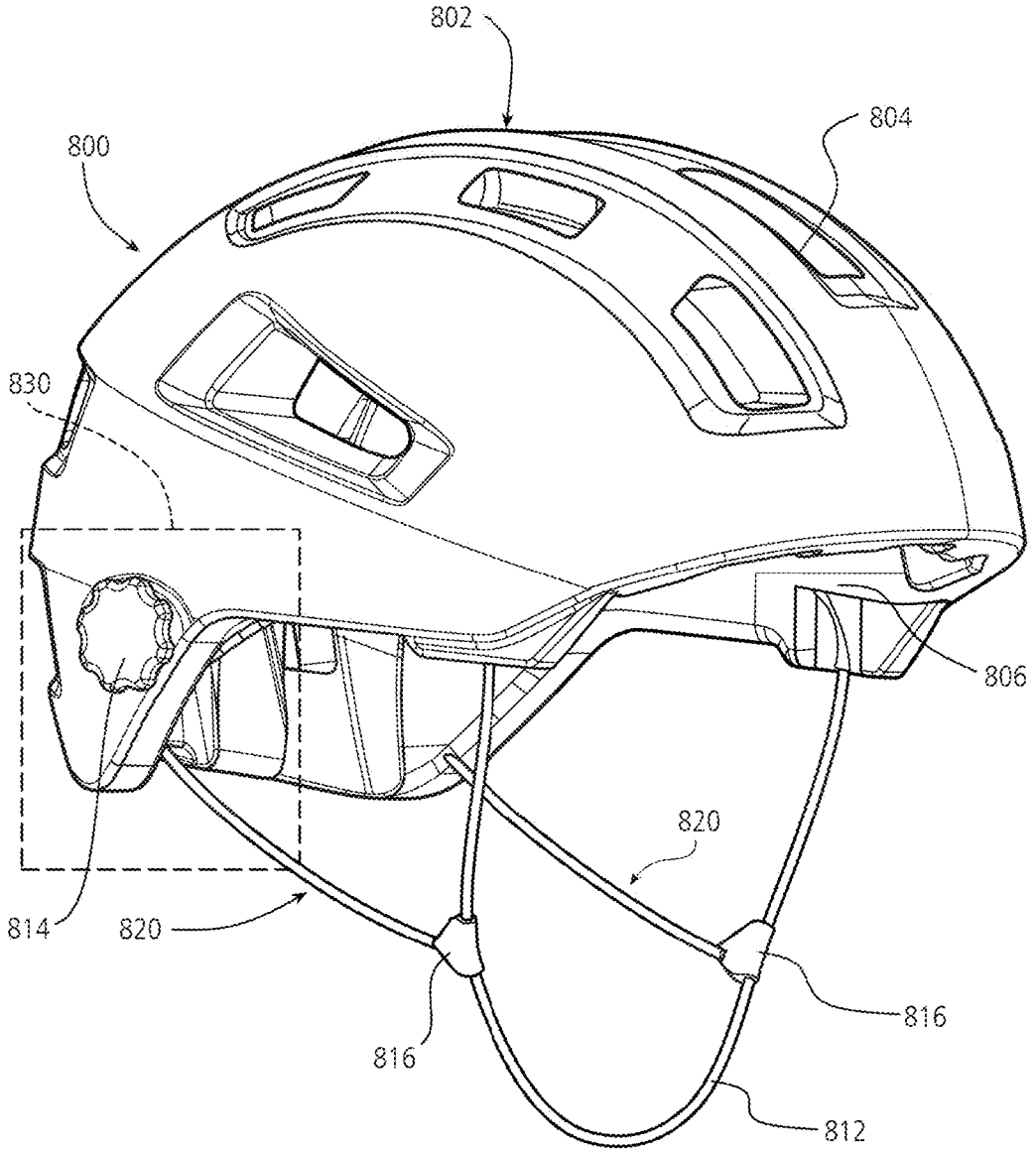

FIGS. 8A-8B illustrate another embodiment of a helmet and adjustable chin strap assembly 800 having a rear tether or leash 820 as part of the chin strap retention system 810. As illustrated, the rear tether or leash 820 can be constructed from the same material as the chin strap 812. The rear tether or leash 820 may include rear arms that engage with the chin strap 812 at an anchor fitting 816. The rear arms of the rear tether or leash 820 are connected to the helmet shell 802, such as to and/or between the inner and outer components 804, 806 of the shell 802. The rear arms may be configured to fit or hang around behind the wearer's ear, while the chin strap 812 may be configured to fit or hang around in front of the wearer's ear. In this way, the rear arms stabilize the chin strap 812 while a wearer is using the helmet and adjustable chin strap assembly 800.

Additionally, the rear tether or leash 820 enables proper geometric placement of the chin strap 812 and anchor fittings 816 on the wearer's head. Proper geometric placement of the chin strap 812 contributes to the safety of the helmet 800, particularly in "roll off" situations, where the helmet 800 is being pulled toward a front or back of the wearer's head. The chin strap 812 may be held at an angle (by the rear tether or leash 820) against a wearer's jaw in such a way that the chin strap 812 cannot be slid off the wearer's jaw or head.

The anchor fitting 816 may be slidable along the chin strap 812. This may contribute to a more comfortable fit of the chin strap 812 and the helmet shell 802. In some embodiments, the anchor fittings 816 may include a lock, latch, or clamping means that will maintain a position of the anchor fittings 816 along the chin strap 812.

Figure 8C:
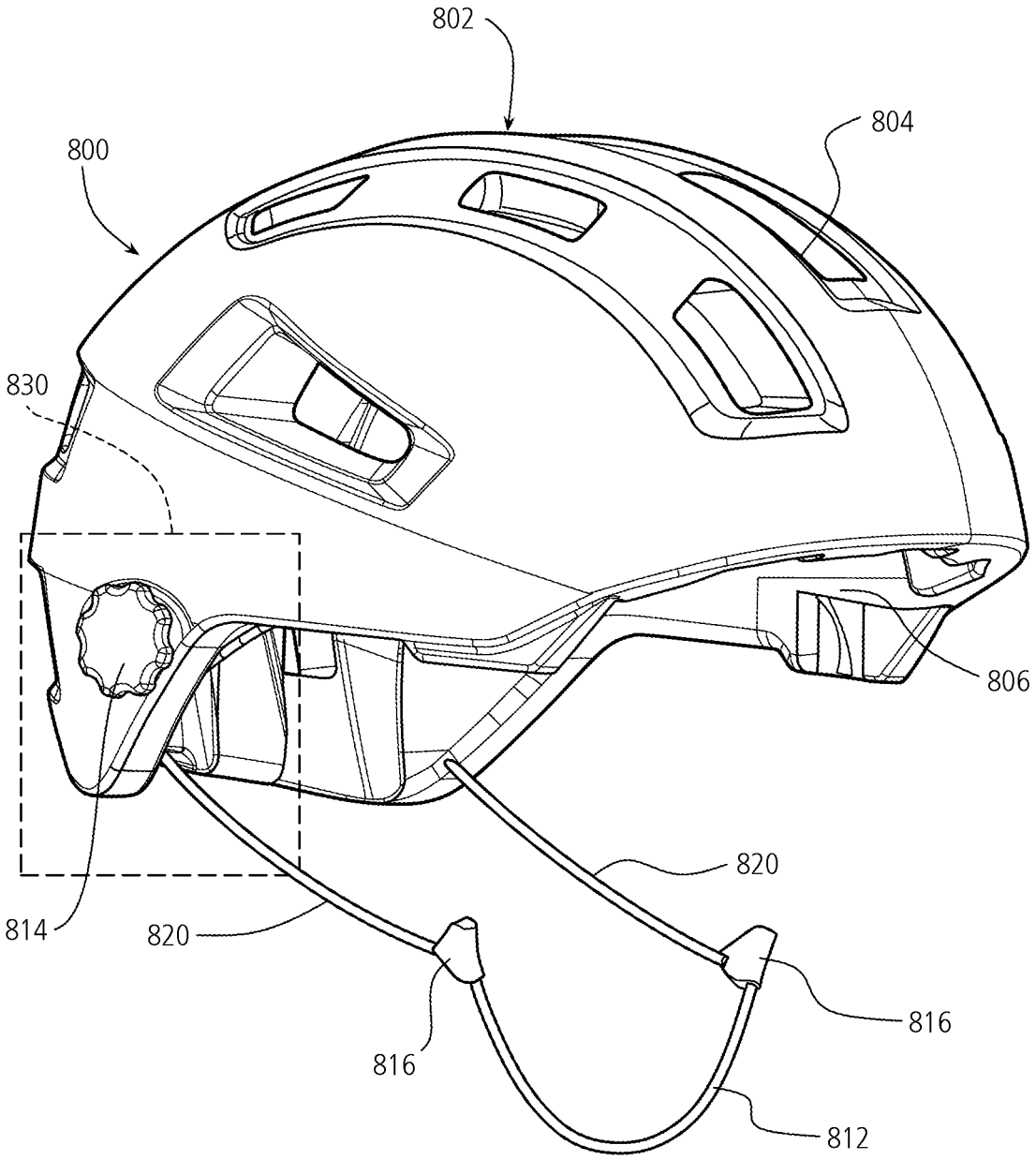

In some embodiments, the rear tether or leash 820 can be semi-rigid. In some embodiments, the rear tether or leash 820 can be a continuous extension of the chin strap 812, such as the embodiment illustrated in FIG. 8C. In FIG. 8C, there are no cables, webbing, straps, etc. in front of the ear, which may enhance the overall comfort of the helmet 800. In another embodiment (not shown, but similar in function to the embodiment illustrated in FIGS. 10A-10G), the rear tether may be of a molded material that extends into a molded "Y" or "V" junction that would encircle the wearer's ear connecting at two locations along the helmet and adjustable chin strap assembly 800, one in front of and one behind the wearer's ear. The foremost structure of the "Y" or "V" would contain an anchor fitting 816 or similar channel, loops, or clips to allow for its retention of the chin strap 812. Beneficially, the molded "Y" or "V" structure would keep the structure away from the ears of the wearer, which may enhance the overall comfort of the helmet 800.

Figure 9A:
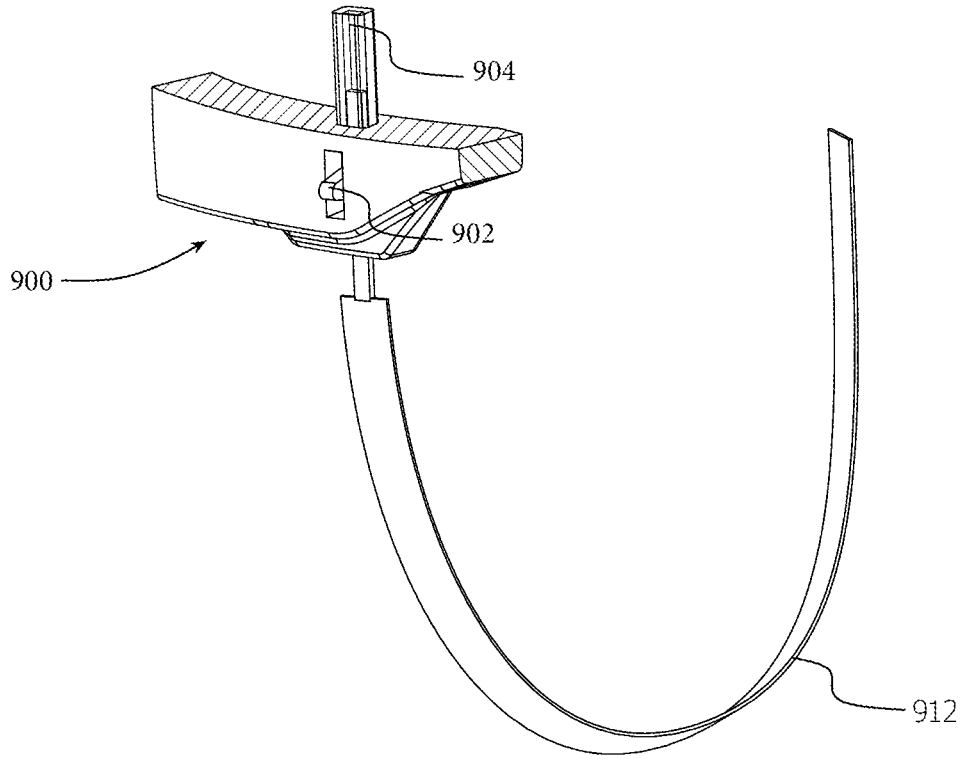
FIGS. 9A-9E schematically illustrate examples of actuator or adjustment mechanisms for adjusting a chin strap of a helmet and retention system.

FIGS. 9A-9E illustrate various embodiments and examples of an actuator or adjustment mechanism to adjust a chin strap of a helmet and adjustable chin strap assembly, such as the helmet shell and chin strap retentions systems described herein. FIG. 9A illustrates a slide-type actuator 900 which includes a toggle switch 902 and a ribbon 904. The ribbon 904 is configured to extend into a shell (e.g., shell 102, 202, 302, 602, 802) and engage with the toggle switch 902. In some embodiments, the ribbon 904 can be attached to an end of the chin strap 912. In some embodiments, the ribbon 904 can be an extension of an end of the chin strap 912. A wearer may move the toggle switch 902 'up' one or more times to selectively and progressively tighten the chin strap 912 and may move the switch 'down' one or more times to selectively and progressively loosen the chin strap 912.

Figure 9B:
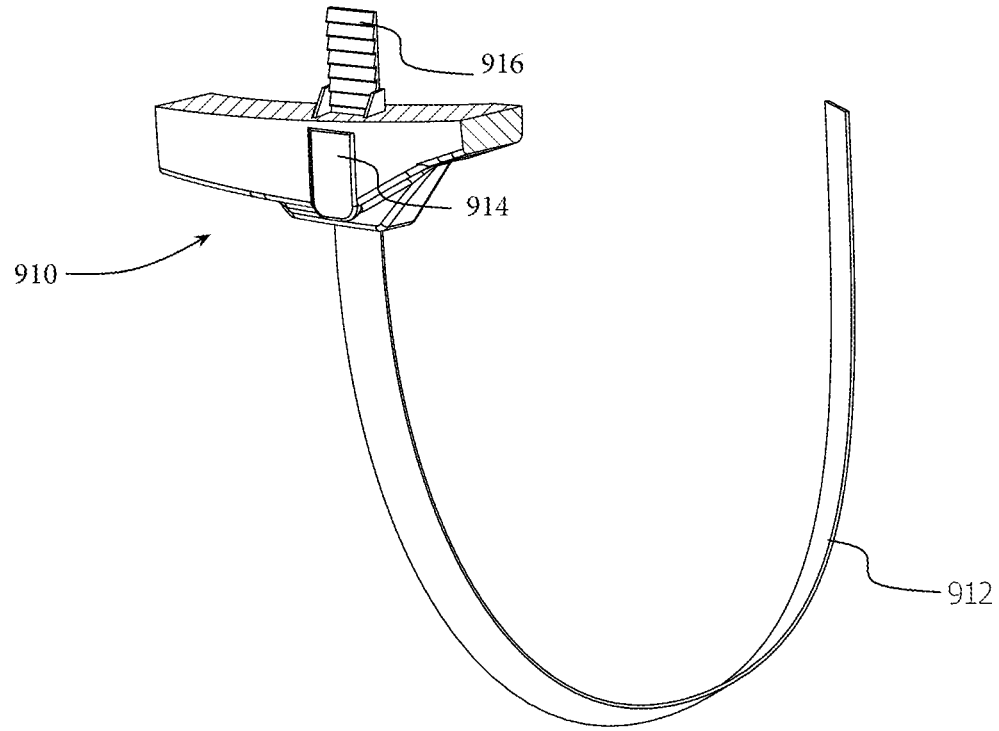

FIG. 9B illustrates a buckle-type actuator 910, similar to the actuator 314 in FIG. 3A. The buckle-type actuator 910 includes a buckle 914 and a buckle catch 916, similar to the micro buckles of a ski boot. The buckle 914 engages the buckle catch 916 to either tighten or loosen the chin strap 912. As shown in FIG. 9B, the buckle 914 may be partially embedded in a helmet shell (e.g., helmet shell 102, 202, 302, 602, or 802).

Figure 9C:
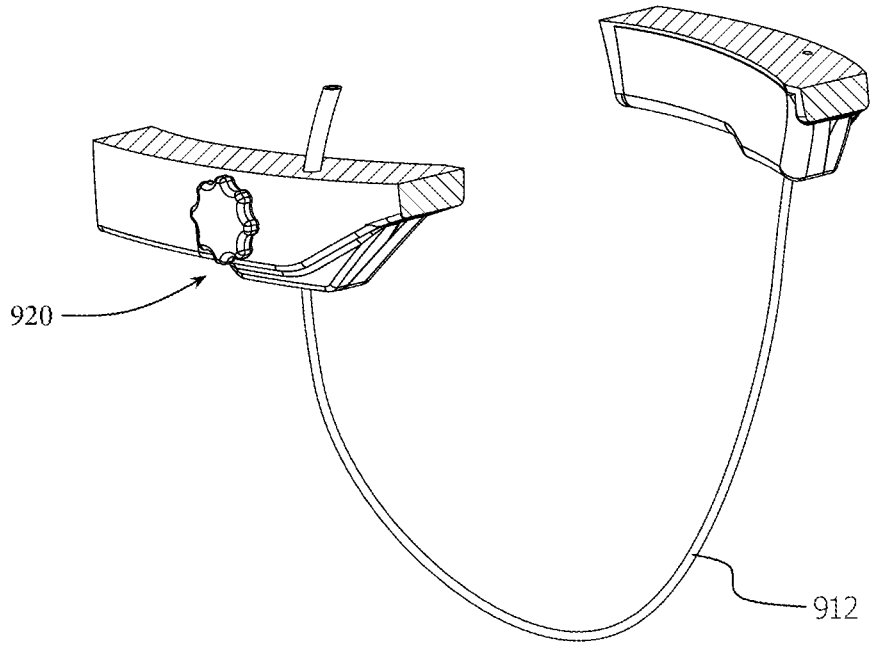
Figure 9D:
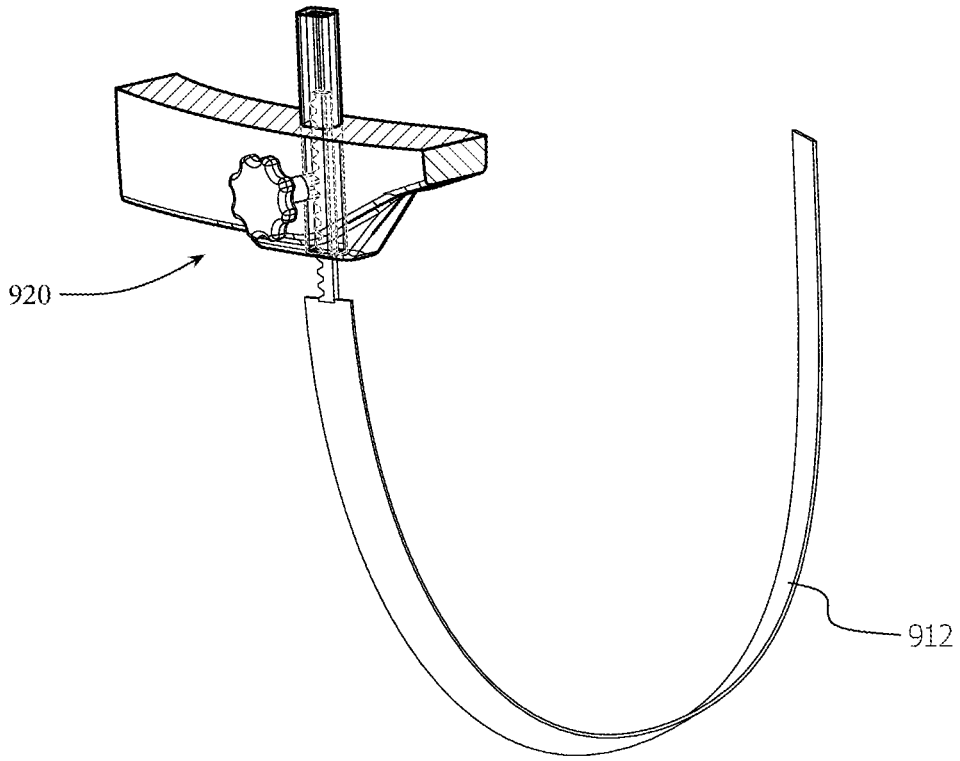
Figure 9E:
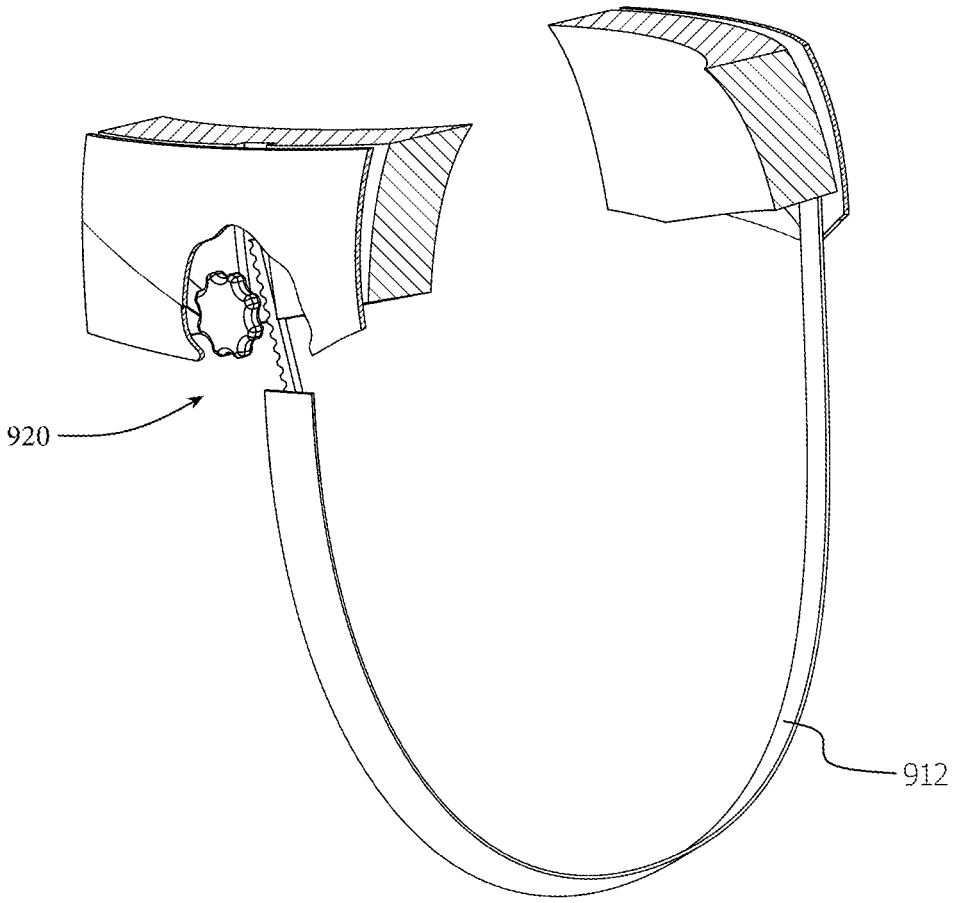

FIGS. 9C-9E illustrate various components and placements of an actuator 920, similar to the actuator 214 in FIG. 2. As illustrated in FIGS. 9D and 9E, the actuator 920 can be a wheel that engages a pinion gear (see also FIG. 2). The actuator wheel 920 may be attached to the shell on an external surface (e.g., on an external surface of the outer component). Alternatively, the actuator wheel 920 may be at least partially embedded in the helmet shell, such as sandwiched between inner and outer components. If the actuator wheel 920 is embedded in the shell, a portion of the wheel will be accessible to the wearer.

Figure 10A:
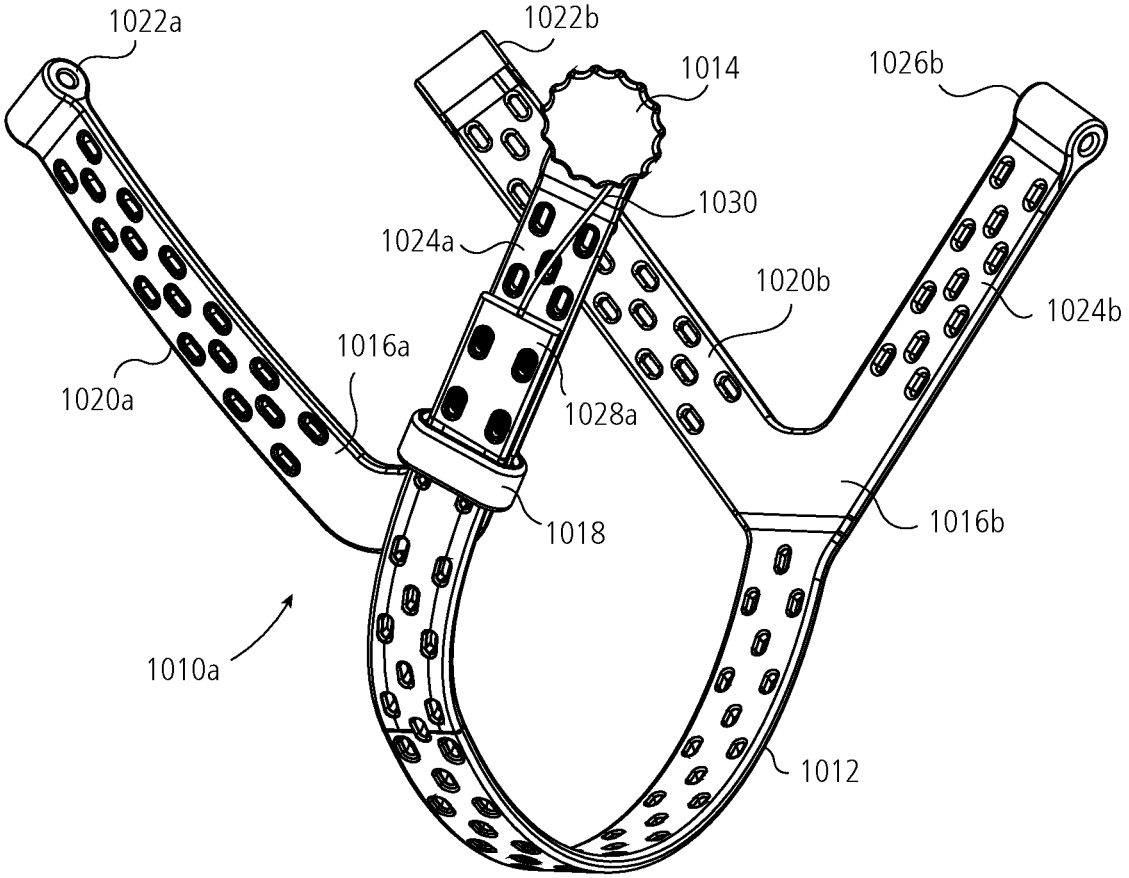
FIGS. 10A-10G schematically illustrate embodiments of a chin strap assembly that includes Y-shaped helmet attachment structures made from molded plastic.

FIGS. 10A-10G illustrate embodiments of a chin strap retention system 1010 having Y-shaped helmet shell attachment structures. As illustrated in FIG. 10A, the chin strap retention system 1010 includes a chin strap 1012 and an actuator 1014 that functions to selectively shorten or lengthen the chin strap 1012 by rotating the actuator 1014 one direction or the other. The chin strap retention system 1010 includes first and second Y-shaped connectors 1016*a*, 1016*b* that are designed to attach the chin strap 1012 to right and left side regions or ear areas, respectively, of a protective helmet shell (not shown). One will appreciate that the foregoing structures of the chin strap retention system 1010 can be reversed in order for the actuator to be positioned on the opposite side of the helmet shell.

As illustrated in FIG. 10A, the first Y-shaped connector 1016*a* can be a separately formed piece that is slidably connected to the chin strap 1012 by means of a retention loop 1018. The first Y-shaped connector 1016*a* includes a rear tether 1020*a* having a rear end 1022*a* designed to connect to a helmet at a location rearward of the wearer's right ear and a front tether 1024*a* having a front end 1026*a* (see FIG. 10F)) designed to connect to a helmet at a location forward of the wearer's right ear. The second Y-shaped connector 1016*b* can be integrally formed with the chin strap 1012 and includes a rear tether 1020*b* having a rear end 1022*b* designed to connect to a helmet at a location rearward of the wearer's left ear and a front tether 1024*b* having a front end 1026*b* designed to connect to the helmet at a location forward of the wearer's left ear. As illustrated, the rear ends 1022*a*, 1022*b* and front ends 1026*a*, 1026*b* can have hollow cylindrical structures configured to receive therethrough corresponding attachment bars or rods (not shown) rigidly or rotatably connected to the helmet shell. In this way, the first and second Y-shaped connectors 1016*a*, 1016*b* can pivot or rotate relative to the helmet shell for improved fit and comfort to the user, particularly where the Y-shaped connectors 1016*a*, 1016*b* are rigid or semi-rigid.

As illustrated in FIG. 10A, the actuator 1014 can be operably connected to a free end 1028 of the chin strap 1012 adjacent to the front tether 1024*a* of the first Y-shaped connector 1016*a* by means of a flexible cable or wire 1030. As illustrated, rotation of the actuator 1014 counterclockwise will wind up the cable or wire 1030 to draw the free end 1028 of the chin strap 1012 toward the helmet, thereby shortening the chin strap 1012 and creating a tighter fit under the wearer's chin. Conversely, rotation of the actuator 1014 clockwise will unwind the cable or wire 1030 and permit the free end 1028 of the chin strap 1012 to move away from the helmet, thereby lengthening the chin strap 1012 and creating a looser fit under the wearer's chin and/or permitting the user to remove the helmet by pulling the chin strap forward in front of the wearer's chin and upward in front of the face. The actuator 1014 can be retained in a desired rotational position to fix the length of the chin strap 1012 by a sufficiently tight friction fit and/or by a spring-loaded ratchet mechanism (not shown).

It will be appreciated that the actuator 1014 and the cable or wire 1030 can be reconfigured so that rotating the actuator 1014 clockwise will tighten the chin strap 1012 and rotating the actuator 1014 counterclockwise will loosen the chin strap 1012. Other ratchet mechanisms are possible, such as where repeatedly rotating the actuator 1014 back and forth winds up the cable or wire 1030 to tighten the chin strap 1012, and depressing or retracting the actuator 1014 releases the cable or wire 1030 and permits lengthening of the chin strap 1012.

Figure 10B:
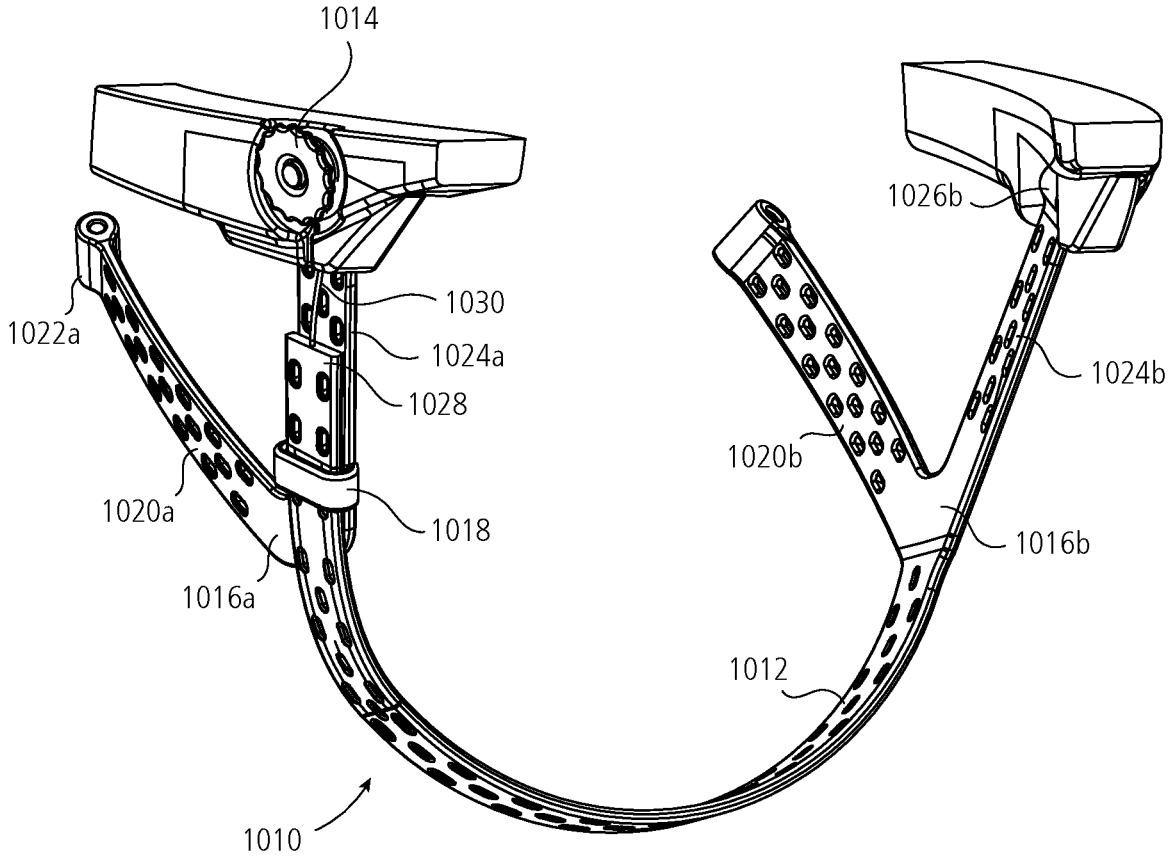
Figure 10C:
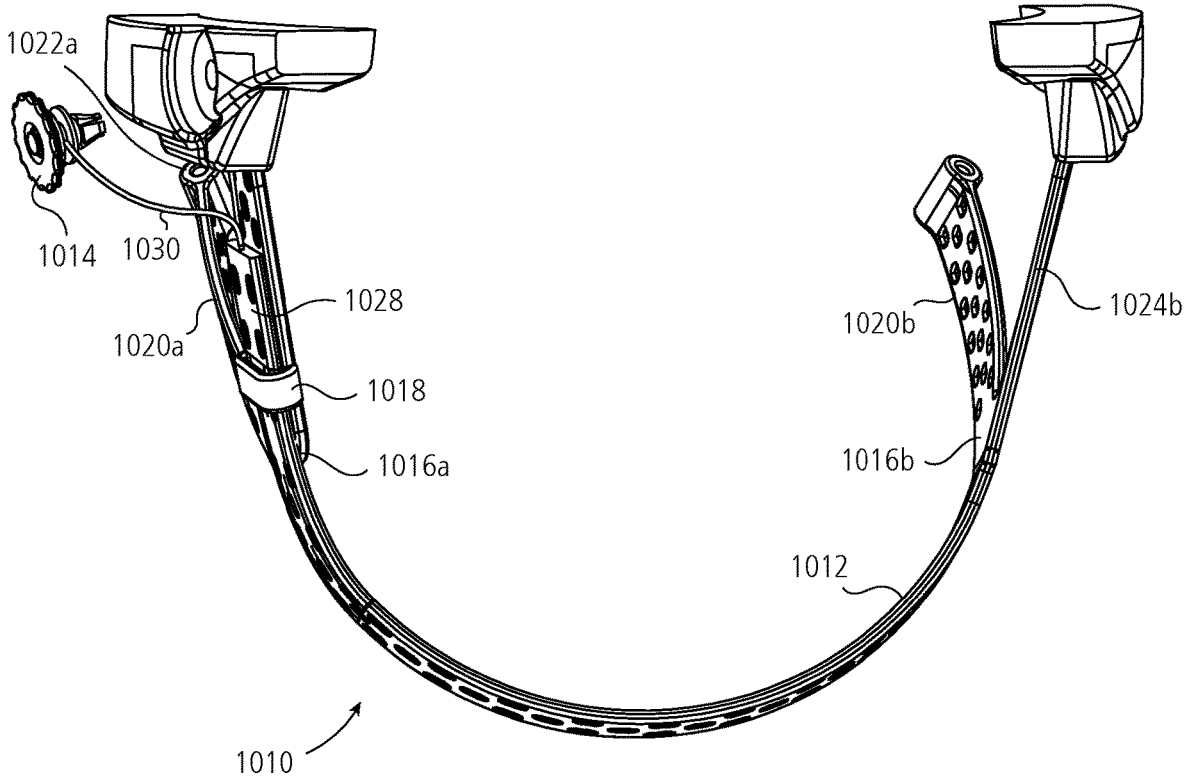

FIGS. 10B and 10C illustrate an embodiment in which the free end 1028 of the chin strap 1012 can be selectively attached to and released from the helmet by removing the actuator 1014 from a hole 1032 formed in a left portion 1034*a* of the helmet. FIG. 10B shows the actuator 1014 positioned in the hole 1032 and operable to selectively shorten or length the chin strap 1012 as discussed above. FIG. 10C shows the actuator 1014 removed from the hole 1032, which permits detachment of the free end 1028 of the chin strap 1012 from the helmet shell. In some embodiments, the retention loop 1018 can be released from the front tether 1024*a* of the first Y-shaped connector 1016*a* in order to decouple the free end 1028 of the chin strap 1012 from the first Y-shaped connector 1016*a*. This permits the wearer to more easily install and remove the helmet without having to pull the chin strap 1012 in front of the wearer's face. In this embodiment, the second Y-shaped connector 1016*b* can remain non-removably attached the helmet.

Figure 10D:
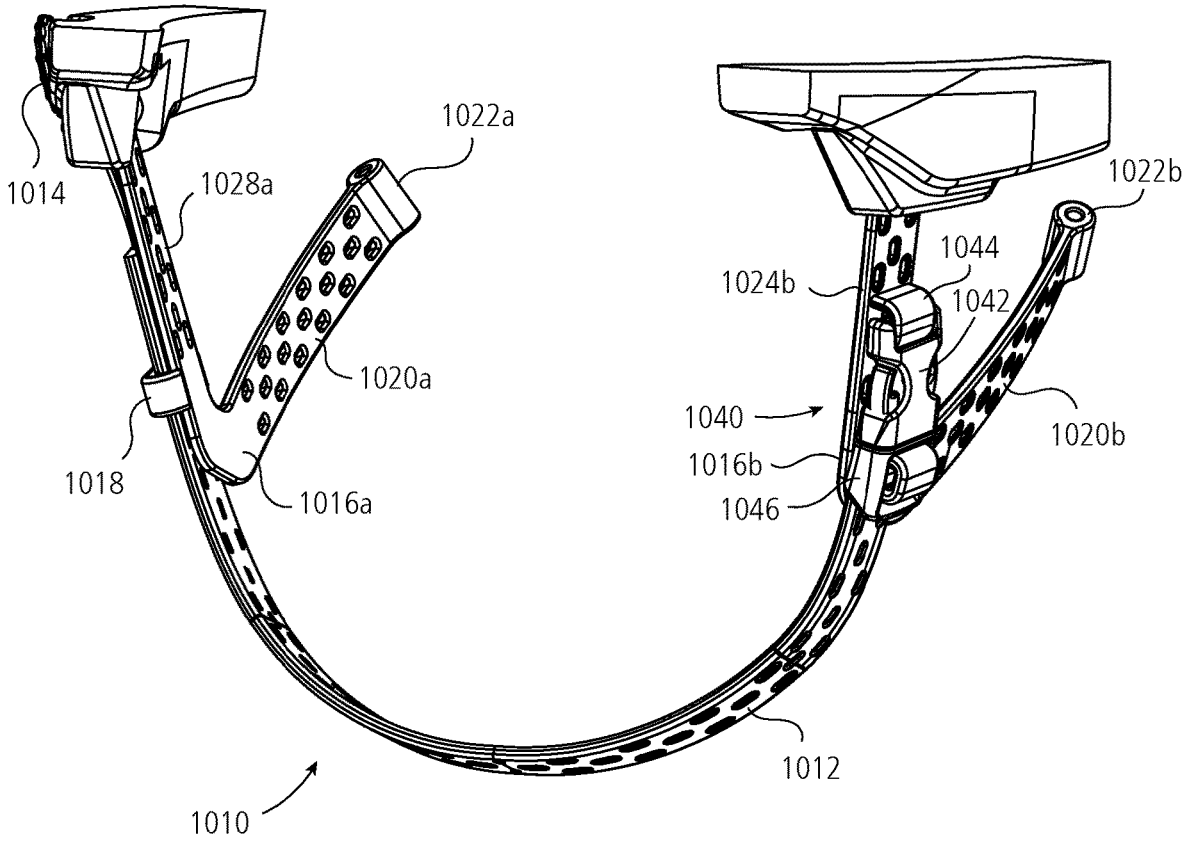
Figure 10E:
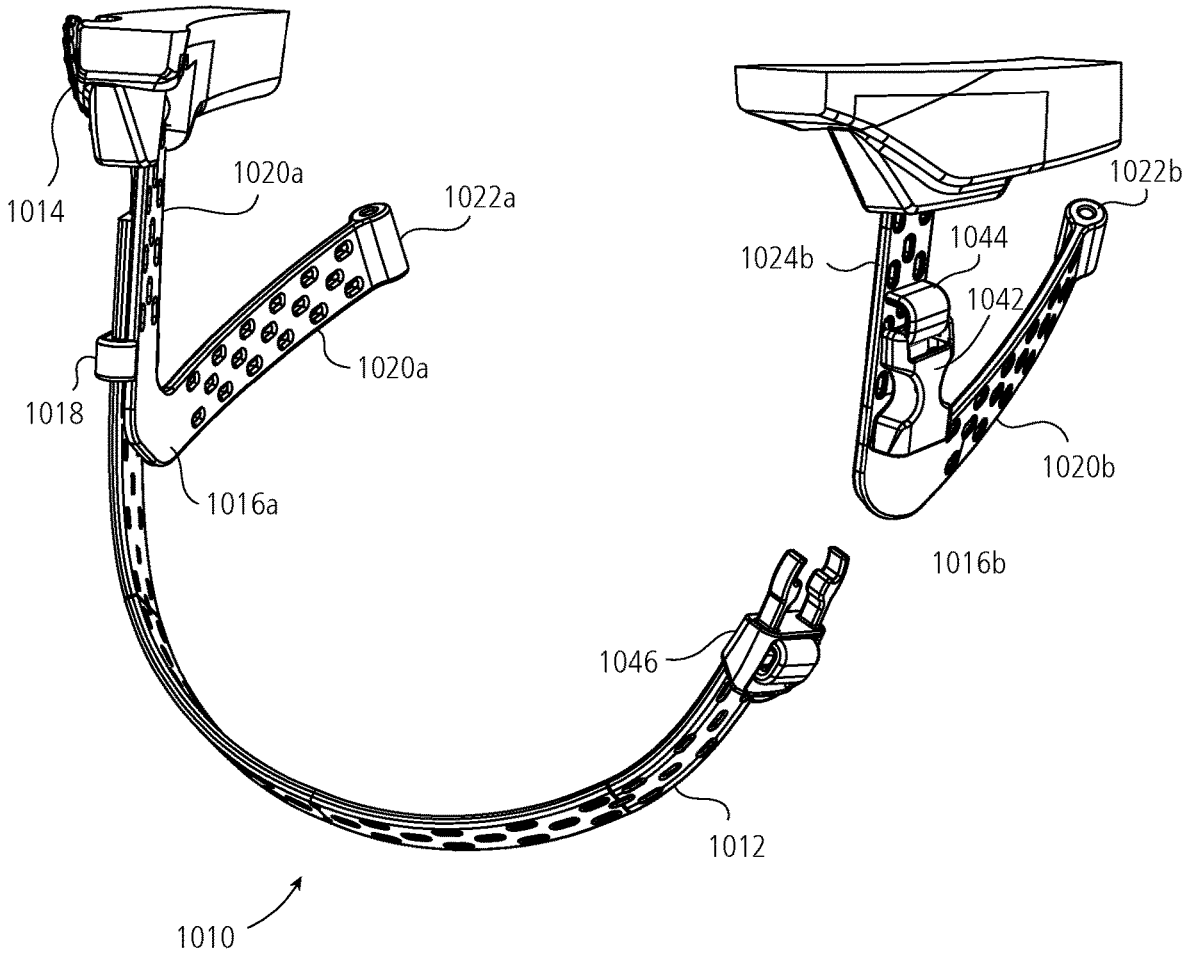

FIGS. 10D and 10E illustrate an embodiment in which the chin strap assembly 1010 includes first and second Y-shaped connectors 1016*a*, 1016*b* that are both separately formed from and attached to the chin strap 1012. As illustrated, the first Y-shaped connector 1016*a* can be connected to the chin strap 1012 by the retention loop 1018 as in the embodiment shown in FIGS. 10A-10C, with the actuator 1014 functioning in the same way, except that the actuator 1014 may or may not be removable from the helmet to release a first free end 1018*a* of the chin strap 1012 from the helmet. That is because the embodiment shown in FIGS. 10D and 10E includes a release mechanism 1040 that permits an opposite, second free end 1018*b* of the chin strap 1012 to be selectively attached to and released from the second Y-shaped connector 1016*b*. Detaching the second free end 1018*b* of the chin strap 1012 from the second Y-shaped connector 1016*b* permits the wearer to more easily remove and install the helmet without having to pull the chin strap 1012 in front of the wearer's face.

As illustrated in FIGS. 10D and 10E, the release mechanism 1040 can be a snap buckle with a first buckle piece 1042 attached to the second Y-shaped connector 1016*b* via an attachment structure 1044 and a second buckle piece 1046 attached to the second free end 1018*b* of the chin strap 1012. As illustrated, the first buckle piece 1042 includes a hollow receiving body configured to receive therein flexible prongs of the second buckle piece 1046 in a snap fit configuration. To release the second free end 1018*b* of the chin strap 1012 from the second Y-shaped connector 1016*b*, the wearer can simply detach the second buckle piece 1046 from the first buckle piece 1042, such as by squeezing together the flexible prongs through side windows of the first buckle piece 1042 and pulling the prongs out of the hollow receiving body of the first buckle piece 1042. To reattach the second free end 1018*b* of the chin strap 1012 to the second Y-shaped connector 1016*b*, the wearer can simply insert the flexible prongs of the second buckle piece 1046 into the hollow receiving body of the first buckle piece 1042 until they snap in a locked position.

Figure 10F:
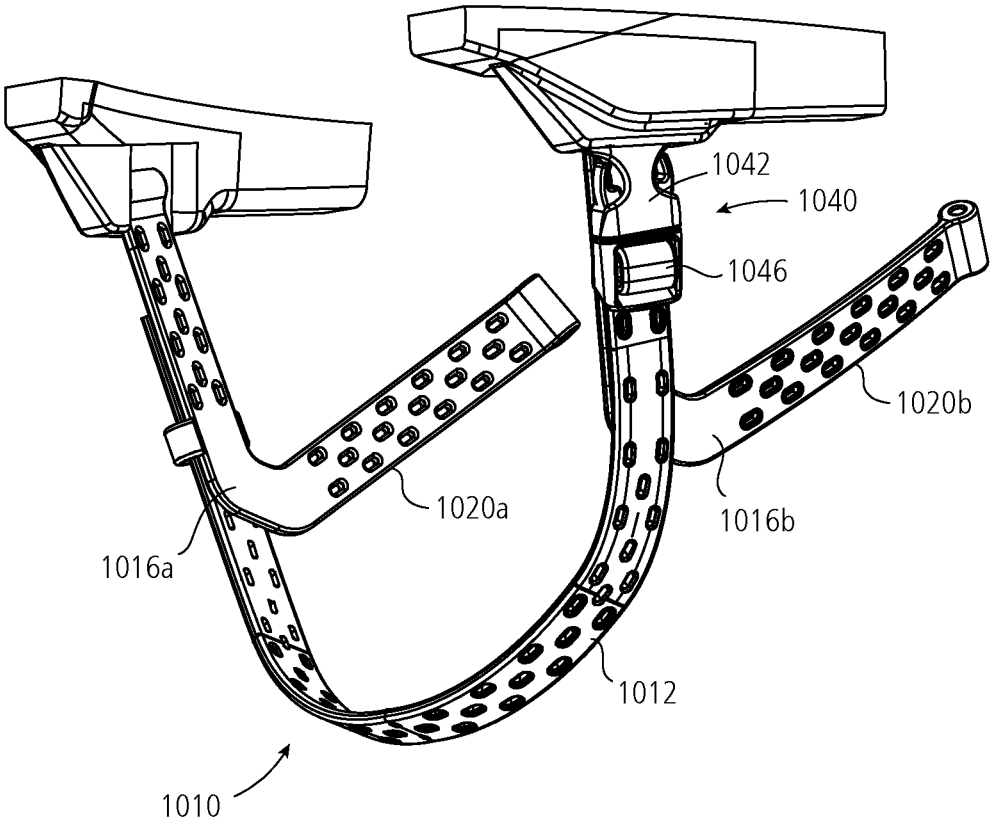
Figure 10G:
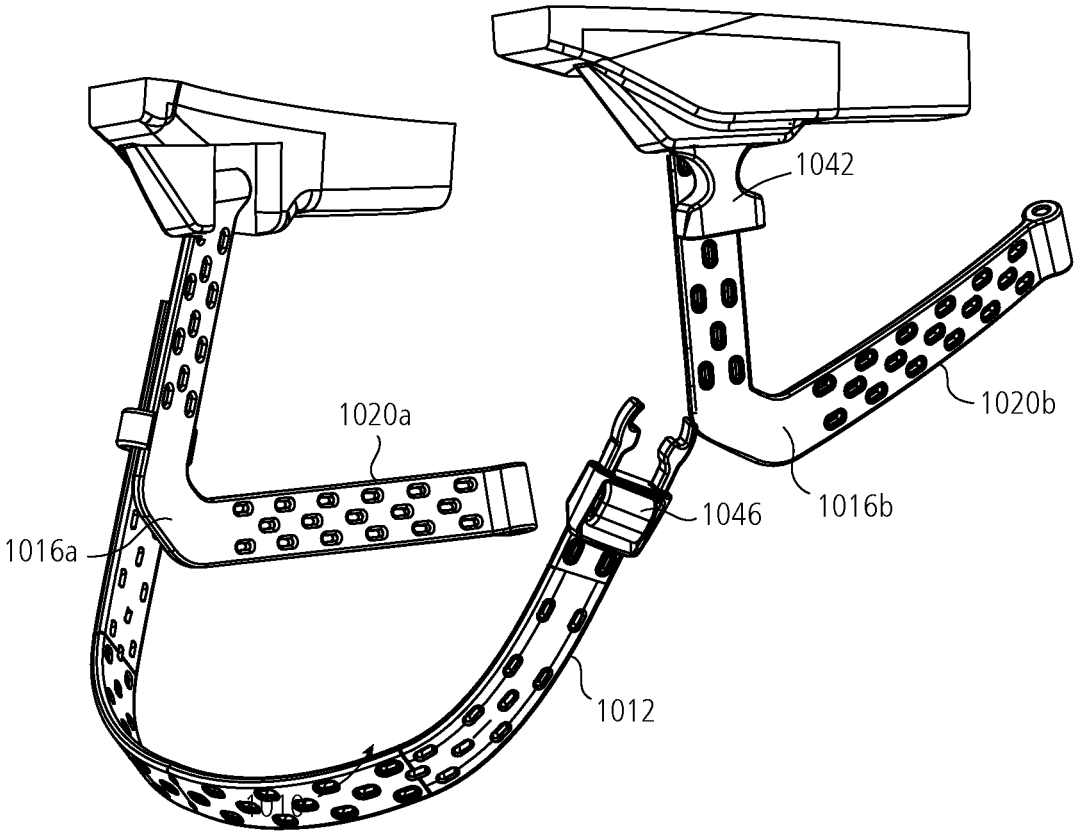

FIGS. 10F and 10G illustrate another embodiment in which the chin strap assembly 1010 includes first and second Y-shaped connectors 1016*a*, 1016*b* that are both separately formed from and attached to the chin strap 1012. As illustrated, the first Y-shaped connector 1016*a* can be connected to the chin strap 1012 by the loop 1018 as in the embodiments shown in FIGS. 10A-10E, with the actuator 1014 functioning in the same way, except that the actuator 1014 may or may not be removable from the helmet to release a first free end 1018*a* of the chin strap 1012 from the helmet. That is because the embodiment shown in FIGS. 10F and 10G includes a release mechanism 1040 that permits a second free end 1018*b* of the chin strap 1012 to be selectively attached to and released from a side of the helmet. Detaching the second free end 1018*b* of the chin strap 1012 from a side of the helmet permits the wearer to more easily remove and install the helmet without having to pull the chin strap 1012 in front of the wearer's face.

As illustrated in FIGS. 10F and 10G, the release mechanism 1040 can be a snap buckle with a first buckle piece 1042 fixedly attached to a side the helmet shell via an attachment structure 1044 and a second buckle piece 1046 attached to the second free end 1018*b* of the chin strap 1012.

The first buckle piece 1042 includes a hollow receiving body configured to receive therein flexible prongs of the second buckle piece 1046 in a snap fit configuration. To release the second free end 1018*b* of the chin strap 1012 from the side of the helmet, the wearer can simply detach the second buckle piece 1046 from the first buckle piece 1042, such as by squeezing together the flexible prongs through side windows of the first buckle piece 1042 and pulling the prongs out of the hollow receiving body of the first buckle piece 1042. To reattach the second free end 1018*b* of the chin strap 1012 to the side of the helmet, the wearer can simply insert the flexible prongs of the second buckle piece 1046 into the hollow receiving body of the first buckle piece 1042 until they snap in a locked position.

It will be appreciated that the embodiments illustrated in FIGS. 10A-10G can be modified to include other release mechanisms, such as Velcro® (hook and loop system), snaps, screws, clips, hooks, and the like.

Methods of Manufacturing

In some embodiments, the shell is manufactured as a single piece. That is, a thin piece of plastic (i.e., the outer component of the shell) is placed in a mold and conforms to the surface of the mold. Beads of polystyrene (i.e., the inner component of the shell) are then added to the mold and then injected with steam under pressure. The steam expands the polystyrene beads, forming them into the shape of the mold, essentially making a completed shell of the helmet. The thin piece of plastic is also heated by the steam, and it conforms very tightly to the expanded polystyrene (EPS) foam.

In some embodiments, the thin piece of plastic not only adheres to the foam, but leaves no gaps, filling every available bit of space with foam. Thus, the outer component and the inner component of the shell directly interface with each other. In some embodiments, the thin piece of plastic adheres to the foam but leaves a gap between the plastic and foam. This gap is configured to house additional components of the helmet system (e.g., anchor fittings) or receive at least a portion of the chin strap as the chin strap is tightened around the chin of a user.

It should be understood that the features described in relation to one figure are applicable to the features and embodiments of all the figures.

Additional Terms & Definitions

While certain embodiments of the present disclosure have been described in detail, with reference to specific configurations, parameters, components, elements, etcetera, the descriptions are illustrative and are not to be construed as limiting the scope of the claimed invention.

Furthermore, it should be understood that for any given element of component of a described embodiment, any of the possible alternatives listed for that element or component may generally be used individually or in combination with one another, unless implicitly or explicitly stated otherwise.

In addition, unless otherwise indicated, numbers expressing quantities, constituents, distances, or other measurements used in the specification and claims are to be understood as optionally being modified by the term "about" or its synonyms. When the terms "about," "approximately," "substantially," or the like are used in conjunction with a stated amount, value, or condition, it may be taken to mean an amount, value or condition that deviates by less than 20%, less than 10%, less than 5%, less than 1%, less than 0.1%, or less than 0.01% of the stated amount, value, or condition. At the very least, and not as an attempt to limit the application of the doctrine of equivalents to the scope of the claims, each numerical parameter should be construed in light of the number of reported significant digits and by applying ordinary rounding techniques.

Any headings and subheadings used herein are for organizational purposes only and are not meant to be used to limit the scope of the description or the claims.

It will also be noted that, as used in this specification and the appended claims, the singular forms "a," "an" and "the" do not exclude plural referents unless the context clearly dictates otherwise. Thus, for example, an embodiment referencing a singular referent (e.g., "widget") may also include two or more such referents.

It will also be appreciated that embodiments described herein may also include properties and/or features (e.g., ingredients, components, members, elements, parts, and/or portions) described in one or more separate embodiments and are not necessarily limited strictly to the features expressly described for that particular embodiment. Accordingly, the various features of a given embodiment can be combined with and/or incorporated into other embodiments of the present disclosure. Thus, disclosure of certain features relative to a specific embodiment of the present disclosure should not be construed as limiting application or inclusion of said features to the specific embodiment. Rather, it will be appreciated that other embodiments can also include such features.

The invention claimed is:

1. A helmet and adjustable chin strap assembly, comprising:

a helmet shell configured to at least partially cover a wearer's head, wherein the helmet shell includes:
an outer component and an inner component;
a front and a back; and
a left side region having a left ear area and a right side region having a right ear area; and an adjustable chin strap retention system including:
a continuous chin strap with no buckle configured to be positioned adjacent to the wearer's chin;
a Y-shaped connector configured to attach the continuous chin strap to either the left side region or the right side region of the helmet shell, wherein the Y-shaped connector is integrally formed with a first end of the continuous chin strap;
a V-shaped connector configured to attach the continuous chin strap to either the left side region or the right side region of the helmet shell that is opposite the Y-shaped connector, wherein the V-shaped connector is slidably connected to a second end of the continuous chin strap, wherein each of the Y-shaped connector and the V-shaped connector includes a rear tether rigidly or rotatably connected to helmet shell rearward of a wearer's ear and a front tether rigidly or rotatably connected to helmet shell forward of the wearer's ear; and
an actuator operably connected to the second end of the continuous chin strap and attached to the helmet shell in a location where one of the tethers of the V-shaped connector is connected to the helmet shell,
wherein manually actuating the actuator by the wearer selectively moves the second end of the continuous chin strap toward or away from the helmet shell in order to selectively tighten or loosen the continuous chin strap relative to the wearer's chin,
wherein the Y-shaped connector and V-shaped connector, when the continuous chin strap is attached to the helmet shell, position the continuous chin strap under the wearer's chin when selectively tightening or loosening the continuous chin strap.

2. The helmet and adjustable chin strap assembly of claim 1, wherein the actuator is selectively detachable from the helmet shell to permit selective decoupling of the second end of the continuous chin strap from the helmet shell.

3. The helmet and adjustable chin strap assembly of claim 1, further comprising a retention member configured to slidably secure the continuous chin strap against the V-shaped connector and to position the continuous chin strap in a position against the wearer's jaw.

4. The helmet and adjustable chin strap assembly of claim 1, wherein the actuator comprises a manually rotatable wheel that is operably connected to the continuous chin strap so that manual rotation of the wheel by the wearer in a first direction selectively tightens the continuous chin strap and manual rotation of the wheel by the wearer in an opposite direction selectively loosens the continuous chin strap.

5. The helmet and adjustable chin strap assembly of claim 1, further comprising a pinion gear connected to or forming part of the continuous chin strap, wherein the actuator includes a wheel configured to engage the pinion gear such that selectively rotating the wheel in a first direction tightens the continuous chin strap and rotating the wheel in an opposite direction loosens the continuous chin strap.

6. The helmet and adjustable chin strap assembly of claim 1, wherein the actuator comprises a lock configured to temporarily lock the actuator and maintain a tightness or looseness of the continuous chin strap while the actuator is locked.

7. The helmet and adjustable chin strap assembly of claim 1, wherein the continuous strap is a monolithic molded component.

8. The helmet and adjustable chin strap assembly of claim 1, wherein the Y-shaped connector and the V-shaped connector are each a monolithic molded component.

9. The helmet and adjustable chin strap assembly of claim 1, wherein the helmet shell includes a channel, groove, or space on a side of the helmet shell adjacent to the actuator configured to house or receive a portion of the second end of the continuous chin strap when the continuous chin strap is selectively tightened or loosened by manual actuation of the actuator by the wearer.

10. The helmet and adjustable chin strap assembly of claim 1, wherein the second end of the continuous chin strap is coupled to the actuator by means of a flexible cable or wire.

11. A helmet and adjustable chin strap assembly, comprising:

a helmet shell configured to at least partially cover a wearer's head, wherein the helmet shell includes:
an outer component and an inner component;
a front and a back; and
a left side region having a left ear area and a right side region having a right ear area;

an adjustable chin strap retention system including:
a continuous chin strap having a first end and a second end and extending between the left ear region and the right ear region, and wherein the continuous chin strap does not contain a buckle that is configured to be positioned adjacent to the wearer's chin;
a first V-shaped connector and a second V-shaped connector positioned at the left side region and the right side region, respectively, the first V-shaped connector and the second V-shaped connector each comprising a first tether and a second tether, wherein the first tether and the second tether both directly attach to the helmet shell at a first end and are attached together at a second end;
a retention member configured to secure the continuous chin strap to a tether of either the first V-shaped connector or the second V-shaped connector;
an actuator connected to one of the left side region or the right side region and being operably connected to the first end of the continuous chin strap, wherein the actuator is configured to selectively tighten or loosen the continuous chin strap relative to the wearer's chin; and
a single release mechanism positioned on the left side region or right side region of the helmet shell opposite the actuator, wherein the single release mechanism is configured to releasably connect the second end of the continuous chin strap to the helmet shell, wherein the V-shaped connectors, when the continuous chin strap is attached to the helmet shell, maintain the continuous chin strap under the wearer's chin when selectively tightening or loosening the continuous chin strap.

12. The helmet and adjustable chin strap assembly of claim 11, wherein the single release mechanism is directly secured to the helmet shell.

13. The helmet and adjustable chin strap assembly of claim 11, wherein the single release mechanism is a buckle.

14. The helmet and adjustable chin strap assembly of claim 11, wherein at least a portion of the actuator that is directly connected to the first end of the continuous chin strap is removably connected to the helmet shell to enable the wearer to decouple the first end of the continuous chin strap from the helmet shell to facilitate installation and removal of the helmet shell to and from the wearer's head while the first V-shaped connector and second V-shaped connectors remain secured to the helmet.

15. The helmet and adjustable chin strap assembly of claim 11, wherein the actuator comprises a manually rotatable wheel that is operably connected to the continuous chin strap so that manual rotation of the wheel by the wearer in a first direction selectively tightens the continuous chin strap and manual rotation of the wheel by the wearer in an opposite direction selectively loosens the continuous chin strap.

16. The helmet and adjustable chin strap assembly of claim 11, wherein the first V-shaped connector is a first monolithic molded component, and the second V-shaped connector is a second monolithic molded component.

17. The helmet and adjustable chin strap assembly of claim 11, wherein the first end of the continuous chin strap is coupled to the actuator by means of a flexible cable or wire.

18. The helmet and adjustable chin strap assembly of claim 11, wherein one of the first or second V-shaped connectors and the continuous chin strap are a single monolithic molded component.

19. A helmet and adjustable chin strap assembly, comprising:

a helmet shell configured to at least partially cover a wearer's head, wherein the helmet shell includes:
an outer component and an inner component;
a front and a back; and
a left side region having a left ear area and a right side region having a right ear area; and an adjustable chin strap retention system including:
a continuous chin strap with no buckle configured to be positioned adjacent to a wearer's chin;

a Y-shaped connector configured to attach the continuous chin strap to either the left side region or the right side region of the helmet shell, wherein the Y-shaped connector is integrally formed with a first end of the continuous chin strap;

a V-shaped connector configured to attach the continuous chin strap to either the left side region or the right side region of the helmet shell that is on a side opposite the Y-shaped connector, wherein the V-shaped connector is slidably connected to a second end of the continuous chin strap, wherein the Y-shaped connector and the V-shaped connector each includes a rear tether rigidly or rotatably connected to helmet shell rearward of a wearer's ear and a front tether rigidly or rotatably connected to helmet shell forward of the wearer's ear;

a retention member configured to slidably connect the second end of the continuous chin strap to the V-shaped connector and to position the continuous chin strap in a position against the wearer's jaw; and an actuator coupled to the second end of the continuous chin strap, the actuator being positioned where a tether of the V-shaped connector is attached to the helmet shell, wherein manually actuating the actuator by the wearer selectively increases or decreases a length of the continuous chin strap relative to the left ear region and right ear region of the helmet shell in order to selectively loosen or tighten the continuous chin strap, and wherein at least a portion of the actuator, that is directly connected to the second end of the continuous chin strap, is removably connected to the helmet shell to enable the wearer to decouple the second end of the continuous chin strap from the helmet shell while the first end of continuous chin strap and the Y-shaped connector remain attached to the helmet shell.

20. The helmet and adjustable chin strap assembly of claim 19, wherein the actuator comprises a manually rotatable wheel that is operably connected to the continuous chin strap so that manual rotation of the wheel by the wearer in a first direction selectively tightens the continuous chin strap and manual rotation of the wheel by the wearer in an opposite direction selectively loosens the continuous chin strap.

21. The helmet and adjustable chin strap assembly of claim 19, wherein the retention member is configured to be releasable from the V-shaped connector in order to decouple the second end of the continuous chin strap from the V-shaped connector, and wherein the actuator is selectively detachable from the helmet shell to permit selective decoupling of the second end of the continuous chin strap from the helmet shell.

* * * * *